US010697138B2

(12) United States Patent
Driskell et al.

(10) Patent No.: US 10,697,138 B2
(45) **Date of Patent: *Jun. 30, 2020**

(54) DIRECTIONAL SURFACE MARKING SAFETY AND GUIDANCE DEVICES AND SYSTEMS

(71) Applicant: Driskell Holdings, LLC, Jacksonville, FL (US)

(72) Inventors: Gregory W. Driskell, St Johns, FL (US); Michael D. Green, Atlantic Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/252,153

(22) Filed: Jan. 18, 2019

(65) Prior Publication Data

US 2019/0177933 A1 Jun. 13, 2019

Related U.S. Application Data

(63) Continuation-in-part of application No. 15/871,962, filed on Jan. 15, 2018, now Pat. No. 10,221,530.

(60) Provisional application No. 62/518,112, filed on Jun. 12, 2017.

(51) Int. Cl.

| | |
|---|---|
| ***E01F 9/553*** | (2016.01) |
| ***E01F 9/529*** | (2016.01) |
| ***E01F 9/559*** | (2016.01) |
| ***E01F 9/512*** | (2016.01) |
| ***E01F 9/50*** | (2016.01) |

(52) U.S. Cl.

CPC ..... *E01F 9/553* (2016.02); *E01F 9/50* (2016.02); *E01F 9/512* (2016.02); *E01F 9/529* (2016.02); *E01F 9/559* (2016.02)

(58) Field of Classification Search

CPC ... E01F 9/529; E01F 9/524; E01F 9/04; E01F 9/08; E01F 9/07; E01F 9/047; E01F 9/553; E01F 9/578; E01F 13/10; B29C 37/0025; B29C 37/02

See application file for complete search history.

(56) References Cited

U.S. PATENT DOCUMENTS 1,740,501 A * 12/1929 Eckstrand ..... E01F 9/529 404/16
2,330,808 A * 10/1943 Bingham ..... G08B 5/008 404/16

(Continued)

FOREIGN PATENT DOCUMENTS

EP 2439338 A2 * 4/2012 ..... E01F 9/50

*Primary Examiner* — Abigail A Risic

(74) *Attorney, Agent, or Firm* — Wilson Dutra, PLLC; Camille A. Wilson

(57) ABSTRACT

In some embodiments, a directional surface marking may provide directional messaging to users based on their direction of travel on a base surface, such as a roadway, walkway, or interior flooring, as non-limiting examples. In some aspects, the directional messaging may comprise different colors, text, or symbols, wherein a user may view different directional messaging on a directional surface marking dependent on direction of travel. In some embodiments, directional surface markings may comprise a profile layer, wherein the profile layer may comprise a plurality of profiles, which may provide a topography that allows for directional messaging utilizing surface colors on the topography.

18 Claims, 17 Drawing Sheets

(56) References Cited

U.S. PATENT DOCUMENTS 2,579,467 A * 12/1951 Brickman ..... E01F 9/578 404/12
3,319,542 A * 5/1967 Bergsnov-Hansen ..... E01F 9/553 359/534
3,355,999 A * 12/1967 Rusling ..... E01F 9/619 404/12
3,739,179 A * 6/1973 Krekow ..... B60R 16/0237 250/216
3,768,383 A * 10/1973 Tucker ..... E01F 9/553 116/63 R
4,040,760 A * 8/1977 Wyckoff ..... E01F 9/524 404/14
4,182,548 A * 1/1980 Searight ..... G02B 5/12 359/531
4,236,788 A * 12/1980 Wyckoff ..... G02B 5/128 359/551
4,332,437 A * 6/1982 Searight ..... E01F 9/578 359/531
4,542,709 A * 9/1985 Spaugh ..... B60Q 7/00 116/63 P
4,573,763 A * 3/1986 Thomas ..... G02B 5/132 359/538
4,712,867 A * 12/1987 Malek ..... E01F 9/524 359/530
5,006,010 A * 4/1991 Duckett ..... E01F 9/553 404/12
6,517,923 B1 * 2/2003 Nakayama ..... G02B 5/124 428/68
7,077,600 B1 * 7/2006 Whinery ..... E01F 9/553 404/12
2002/0001506 A1 * 1/2002 Wilson, Sr. ..... E01C 7/147 404/75
2007/0258764 A1 * 11/2007 Broughton ..... E01F 13/10 404/15
2011/0081201 A1 * 4/2011 Croce ..... E01F 13/10 404/16

* cited by examiner

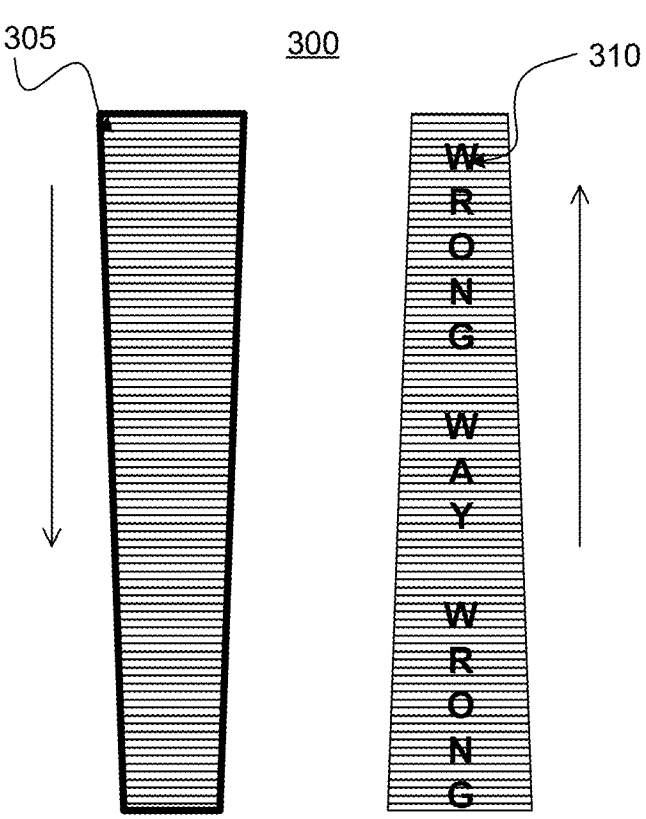
FIG. 3A
FIG. 3B
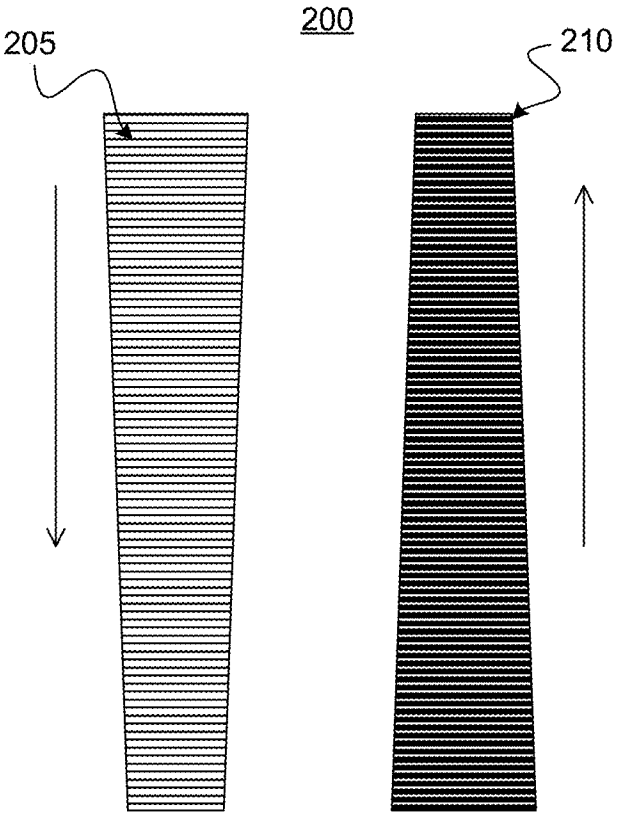
FIG. 2A
FIG. 2B

600

700

800

900

FIG. 12A
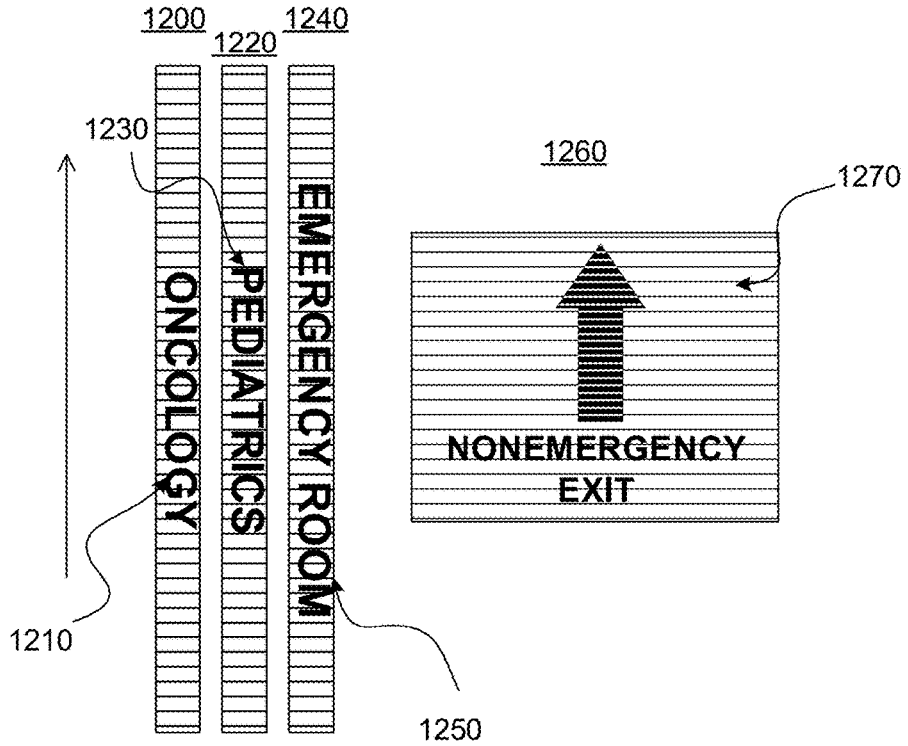
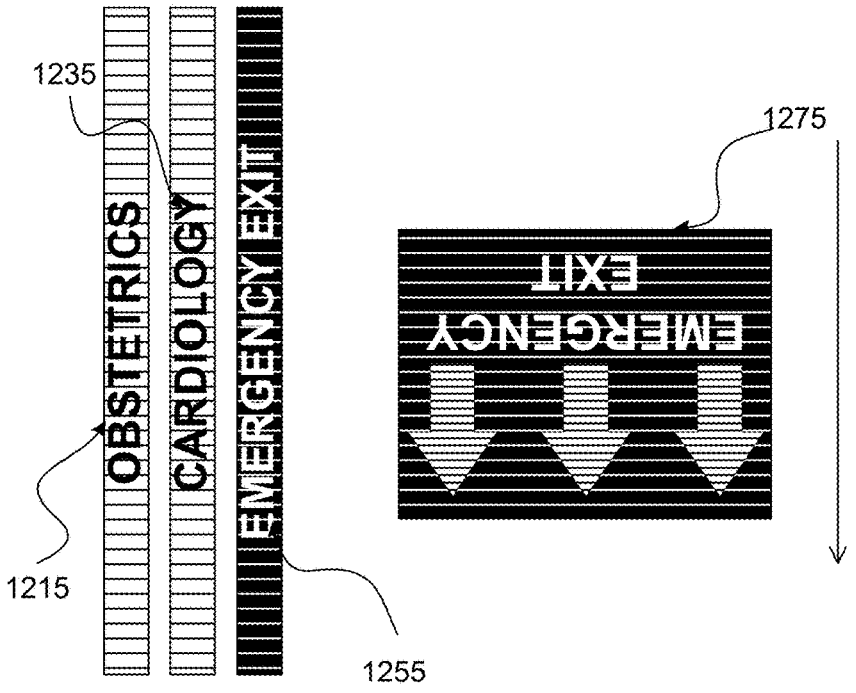
FIG. 12B

DIRECTIONAL SURFACE MARKING SAFETY AND GUIDANCE DEVICES AND SYSTEMS

CROSS-REFERENCE TO RELATED APPLICATION

This application is a Continuation in Part of and claims priority to and the full benefit of U.S. Non-Provisional patent application Ser. No. 15/871,962 (filed Jan. 15, 2018, and titled "DIRECTIONAL SURFACE MARKING SAFETY AND GUIDANCE DEVICES AND SYSTEMS," which claimed priority to and the full benefit of U.S. Provisional Patent Application Ser. No. 62/518,112 (filed Jun. 12, 2017, and titled "DUAL COLOR ROAD MARKER SAFETY DEVICE")), the entire contents of which are incorporated herein by reference.

BACKGROUND OF THE DISCLOSURE

Since the inception of automobiles, motorists have caused or experienced automobile accidents. Head-to-head collisions are some of the deadliest accident types. These accidents most commonly occur when a motorist enters into a divided highway or a one-way roadway in the incorrect direction. These accidents are disproportionally caused by impaired or aged motorists. As a result, there is a great need to alert motorists who unintentionally travel in the incorrect direction.

Motorists, cyclists, and pedestrians utilize various infrastructure elements, such as signs, markings, and markers, to guide them down a road, lane, path, or hallway. One of the most effective elements is that of surface markings or markers. The most common types of applied surface markings on the roadway are longitudinal and lateral lines, symbols, messages, and raised or embedded pavement markers. These markings provide both guidance and warning messages specific to the viewer's need. Unlike a vertically posted sign, surface markings are applied and viewed horizontally on the surface. The result is that viewers traveling in either direction receive the same visual message. At best, these types of markings have limited effectiveness. At worst, these types of markings are confusing to the viewer and impact to their safety.

The color and content of a marking is another important factor for providing a clear concise message to the viewer. The color of these markings provide crucial guidance and warning information to motorists. Yellow markings divide traffic traveling in the opposite direction. White markings are used for lateral and edge lines, symbols, messages, and dividing traffic traveling in the same direction. Red, when used, indicates 'danger' and is often associated with stop, do not enter, or wrong way warnings.

In an effort to reduce horrific accidents on roadways, some agencies deployed intelligent transportation devices like that of radar systems placed in limited locales such as select highway exit ramps. These detect incorrect direction travel and activate a digital warning sign. Though these may be effective, they are extremely expensive and can only be installed in limited environments.

Roadway markings in their current form do little to prevent or alert motorists of incorrect direction travel. Longitudinal and lateral lane lines do not provide clear orientation of the travelway's direction. The orientation of symbols and legends do provide some conspicuity of the travel direction to normal non-impaired motorists, but are only slightly effective and nearly undistinguishable to an impaired motorist. Agencies are reluctant to install additional conventional bidirectional roadway markings since they are concerned with distracting or confusing a motorist traveling in the correct direction.

Supplemental raised or embedded markers are periodically installed on or parallel to the lane lines to aid drivers in identifying the markings during nighttime or in adverse weather conditions. These markers are traditionally the same color as the line they are placed on or next to. Some agencies utilize bidirectional markers that display white in one direction and red in the other to assist in incorrect direction alert. However, at a norm of 40-foot centers and less than 8 square inches of displayed color, these have been found to be an inadequate alert device in many cases.

Currently, there is no device specifically designed to provide a bidirectional marking with a unidirectional message dependent upon the direction of travel by the viewer. Surface markings or markers are limited to provide a single message, seen from both directions.

SUMMARY OF THE DISCLOSURE

What is needed is a device and system to provide a conspicuous, clear, concise message or alert to the motorist, viewer, or user. This means that the unique driving and viewing habits of these motorists must be considered when providing such alert. One use of the present disclosure is to reduce wrong way driving incidences on roadways. This disclosure may accomplish this while not causing distractions or confusion to unintended users. The system and devices may be affordable and usable by agencies of most budgets and environments.

The present disclosure provides for a directional surface marking that provides directional messaging to users based on their direction of travel on a base surface, such as a roadway, walkway, or interior flooring, as non-limiting examples. In some aspects, the directional messaging may comprise different colors, text, or symbols, wherein a user may view different directional messaging on a directional surface marking dependent on direction of travel. In some embodiments, directional surface markings may comprise a profile layer, wherein the profile layer may comprise a plurality of profiles, which may allow for an application of directional messaging.

The present disclosure may also be used for pedestrian guidance and warnings. Many pedestrian pathways, as in public parks and hallways of large public buildings such as hospitals, can be very complex and confusing to the traveling pedestrians. Currently guidance is provided mostly by periodically posted vertical and horizontal signage. Often pedestrians will need to traverse the pathway or hallway for several yards between signs that provide direction or guidance. In some larger facilities a surface applied continuous vinyl color coded tape is used to provide such guidance to various departments. However, it is difficult to determine which direction is the department and which is the exit. These methods not only cause the pedestrian aggravation, but present a danger when emergency exiting is necessary.

The present disclosure may also reduce wrong way cycling incidences on bicycle paths and lanes. The installation and use of bicycle paths and lanes are dramatically increasing worldwide. Bicycle paths are normally unidirectional like that of a one-way roadway. Standard white markings are used and no pavement markers are used due to bicycle wheel deflection issues. Bicycle paths can be dangerous in incorrect direction travel as well with the excessive roadway cycling speeds and limited bodily protection.

These paths need alert of incorrect direction travel without significant wheel deflection of the cycle.

The present disclosure may comprise a directional surface marking device comprising a profile layer installable parallel to a base surface, wherein, when installed, a topography of the profile layer allows for at least a first directional messaging and a second directional messaging, the profile layer comprising at least a first profile comprising a first set of surface colors providing a first directional messaging viewable when a user traverses the base surface in a first direction, and a second profile comprising a second set of surface colors providing a second directional messaging viewable when a user traverses the base surface in a second direction.

In some aspects, at least a portion of one or both the first directional messaging and the second directional messaging may comprise one or more text or symbol. In some embodiments, the directional surface marking may comprise a heating layer configured to limit accumulation of frozen precipitate over the profile layer. In some implementations, at least a portion of the profile layer is integrated into the base surface. In some aspects, one or more coatings may provide at least a portion of one or both the first set of surface colors and the second set of surface colors.

In some embodiments, one or more profile layer materials provide at least a portion of one or both the first set of surface colors and the second set of surface colors. In some aspects, the directional surface marking device may comprise one or more illumination sources. In some implementations, the one or more illumination sources may be located within the topography of the profile layer.

In some aspects, at least a portion of the one or more illumination sources may be passive. In some embodiments, at least a portion of the one or more illumination sources may require a power source. In some implementations, at least a portion of the one or more illumination sources may comprise a secondary alert mechanism. In some aspects, the illumination sources may provide at least a portion of the first set of surface colors. In some embodiments, the illumination sources may make one or both the first directional messaging and the second directional messaging more visible.

The present disclosure relates to a directional surface marking device comprising a first profile layer comprising a first visible profile, wherein the first visible profile comprises a first color set providing a first directional messaging; a second profile layer comprising a second visible profile, wherein the second visible profile comprises a second color set providing a second directional messaging, wherein the first profile layer and the second profile layer are combinable to form a combined profile layer installable parallel to a base surface, wherein, when installed, a topography of the combined profile layer allows for the first directional messaging to be viewable when a user traverses the base surface in a first direction, and the second directional messaging to be viewable when a user traverses the base surface in a second direction.

In some aspects, one or both the first profile layer and the second profile layer may comprise a congruous segment. In some embodiments, the first profile layer may comprise at least a first material and the second profile layer comprises at least a second material. In some implementations, the first material and the second material are different. In some aspects, the first material provides at least a portion of the first color set, and the second material may provide at least a portion of the second color set. In some embodiments, one or more coatings may provide at least a portion of one or both the first color set and the second color set. In some implementations, the directional surface marking device may comprise one or more illumination sources.

BRIEF DESCRIPTION OF THE DRAWINGS

The accompanying drawings, that are incorporated in and constitute a part of this specification illustrate several embodiments of the disclosure and, together with the description, serve to explain the principles of the disclosure:

FIG. 2A illustrates a first view of an exemplary longitudinal directional surface marking, wherein the first view may be perceived when a user traverses a base surface in a first direction.

FIG. 2B illustrates a second view of an exemplary longitudinal directional surface marking, wherein the second view may be perceived when a user traverses a base surface in a second direction.

FIG. 3A illustrates a first view of an exemplary longitudinal directional surface marking, wherein the first view may be perceived when a user traverses a base surface in a first direction.

FIG. 3B illustrates a second view of an exemplary longitudinal directional surface marking, wherein the second view may be perceived when a user traverses a base surface in a second direction.

FIG. 12A illustrates a first view of a system of exemplary directional surface markings, wherein the first view may be perceived when a user traverses a base surface in a first direction.

FIG. 12B illustrates a second view of a system of exemplary directional surface markings, wherein the second view may be perceived when a user traverses a base surface in a second direction.

DETAILED DESCRIPTION

Figure 1A:
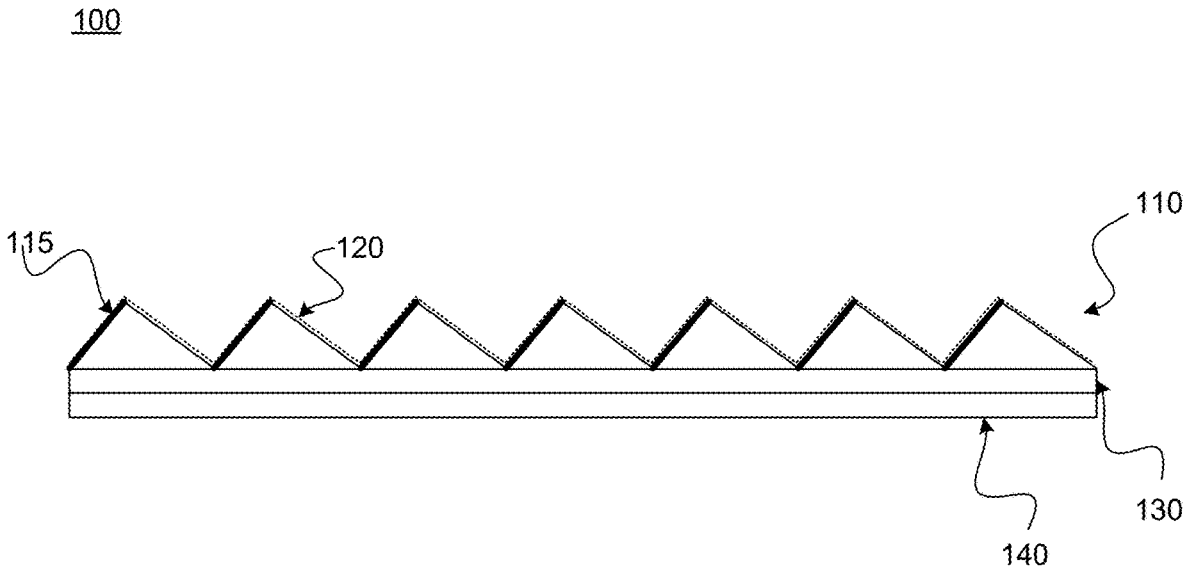
FIG. 1A illustrates a cross section of an exemplary directional surface marking, according to some embodiments of the present disclosure.

The present disclosure provides generally for an improved marking system. More specifically, the present disclosure relates to directional surface markings that may provide directional messaging.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

User: as used herein refers to an individual who may interact with directional surface markings. In some embodiments, a user may comprise a pedestrian, cyclist, motorist, or passenger, as non-limiting examples.

Directional Surface Markings: as used herein refers to a system or device that may provide directional messaging to a user, wherein a user traversing a base surface in a first direction may perceive a first directional message and traversing a base surface in a second direction may perceive a second directional message.

Base Surface: as used herein refers to a traversable surface wherein directional surface markings may be installed horizontally, such as integrated parallel with the base surface, or vertically, such as integrated in a structure extending from a base surface.

Profile Layer: as used herein refers to an upper layer of directional surface markings, which may comprise a topography that may allow for directional messaging. In some aspects, a profile layer may comprise a plurality of profiles, wherein each profile may provide a directional message. For example, a first profile may comprise a series of angled surfaces facing one direction painted with white dotted lines, and a second profile may comprise a series of angled surfaces facing an opposite direction painted with the text "Wrong Direction," wherein facing the first profile allows a user to perceive the white dotted lines and facing the second profile may allow a user to perceive "Wrong Direction."

Directional Message or Directional Messaging: as used herein refers to an informational indication provided by directional surface markings, wherein viewing a directional surface marking from a first direction may provide a first directional message and viewing a directional surface marking from a second direction may provide a second directional message. In some embodiments, a directional message may comprise one or more pattern, symbol, text, or color, as non-limiting examples. In some aspects, a directional message may comprise a surface color set that may create the contrast necessary to convey the directional messaging. For example, a color set for an arrow may comprise white and red, wherein an arrow shape may comprise red and the surrounding area may comprise white. As another example, a color set for a wrong way message may comprise white, black, and red, wherein the background may be white, the letter "wrong way" may be red, and arrows pointing the correct direction may be black. In some embodiments, each directional messaging may comprise a separate color set, such as white and red in a first direction and black and yellow in a second direction.

Figure 1B:
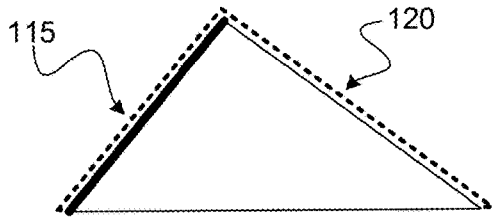
FIG. 1B illustrates a cross section of an exemplary directional surface marking, according to some embodiments of the present disclosure.

Referring now to FIGS. 1A-1B, a cross section of an exemplary directional surface marking 100 is illustrated. In some aspects, a directional surface marking 100 may comprise a profile layer 110 as an upper layer, wherein the profile layer 110 may comprise a first profile 115 and a second profile 120. In some embodiments, the first profile 115 may be coated in a paint or material, wherein the coating may be visible when a user is traversing a base surface in a first direction. In some aspects, the second profile 120 may be coated in a paint or material, wherein the coating may be visible when a user is traversing a base surface in a second direction. In some implementations, the first direction may be the opposite direction of the second direction.

In some aspects, the profile layer 110 may be coated with a paint or material that may enhance one or more characteristics of the directional surface marking 100, such as visibility or durability, as non-limiting examples. For example, the profile layer 110 may be coated with a retroreflective material, which may enhance visibility of the profile layer 110 where the base surface may be traversed by vehicles or users with portable lighting. For example, the base coating may comprise a pigment, and a top coat may comprise glass micro-spheres. In some embodiments, the profile layer 110 may comprise a flexible material, such as a polymeric, rubber, epoxy, or acrylic, as non-limiting examples. In some implementations, at least a portion of the profile layer 110 may comprise a rigid material, such as a cement, asphalt, glass, or other rigid material.

In some implementations, directional surface markings 100 may comprise a plurality of layers. In some embodiments, the directional surface markings 100 may comprise a conformance layer 130 and an adhesive layer 140. In some aspects, the adhesive layer 140 may allow for installation of the directional surface markings 100 into a base surface. For example, the directional surface markings 100 may be attached through adhesive bonding, thermal bonding, or mechanically fastened, as non-limiting examples. In some embodiments, the method of installation may depend on the base surface, such as a concrete walkway, an asphalt roadway, or interior flooring, as non-limiting examples.

In some embodiments, directional surface markings 100 may be manufactured through one or more manufacturing techniques, such as compression, calendaring, extrusion, injection, transfer, or 3D printing, as non-limiting examples. In some implementations, the method of manufacture may depend on the application, such as the type of base surface, as installing directional surface markings 100 on an asphalt roadway may have different requirements than on an interior pedestrian walkway.

In some aspects, the angles and height of the first and second profile may depend on the use. For example, where the base surface may comprise a roadway, the height may need to be low enough as to not impede the ability to drive over the base surface, and the angle may need to be perceptible to drivers and passengers. As another example, where the base surface may comprise an interior walkway, the height may need to be low enough as to not cause pedestrians to trip or stumble, and the angle need to be perceptible to pedestrians of various sizes, including those who may be in a wheelchair.

As an illustrative example, the directional surface markings 100 may be installed on a roadway, wherein users may traverse the base surface in a vehicle. Drivers and passengers may be able to view acute profiles that may face the direction of travel. For example, the first profile 115 may comprise a series of 65 degree angles, and the second profile 120 may comprise a series of 35 degree angles.

Referring now to FIGS. 2A-2B, an exemplary longitudinal directional surface marking 200 is illustrated, wherein FIG. 2A and FIG. 2B illustrate views of the longitudinal directional surface marking 200 from opposite directions. In some aspects, as illustrated in FIG. 2A, traversing a base surface in a first direction may show a first color 205, such as one that may blend with the base surface. In some embodiments, as illustrated in FIG. 2B, traversing a base surface in a second a direction may show a first directional message 210, such as a color indicator that may indicate a vehicle is traversing a roadway in the wrong direction.

Referring now to FIGS. 3A-3B, an exemplary longitudinal directional surface marking 300 is illustrated, wherein FIG. 3A and FIG. 3B illustrate views of the longitudinal directional surface marking 300 from opposite directions. In some implementations, as illustrated in FIG. 3A, traversing a base surface in a first direction may show a first color 305, such as one that may blend with the base surface. In some embodiments, as illustrated in FIG. 3B, traversing a base surface in a second a direction may show a first directional message 310, such as a text indicator that may indicate a vehicle is traversing a roadway in the wrong direction.

Figure 4B:
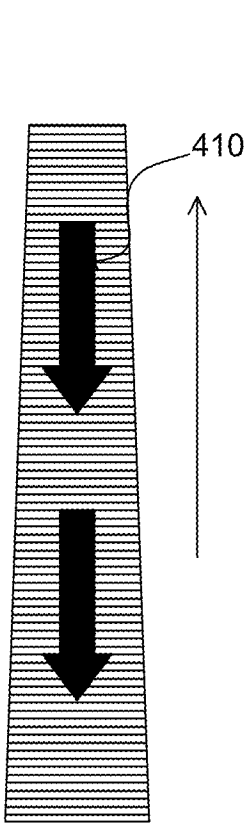
FIG. 4B illustrates a second view of an exemplary longitudinal directional surface marking, wherein the second view may be perceived when a user traverses a base surface in a second direction.
Figure 4A:
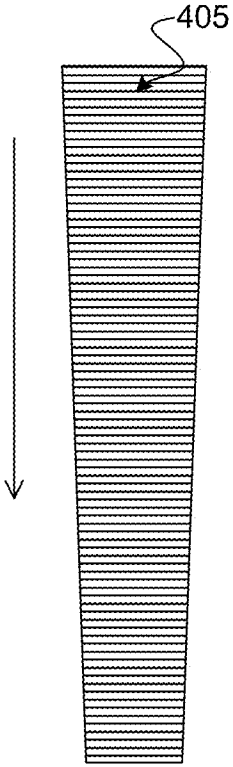
FIG. 4A illustrates a first view of an exemplary longitudinal directional surface marking, wherein the first view may be perceived when a user traverses a base surface in a first direction.

Referring now to FIGS. 4A-4B, an exemplary longitudinal directional surface marking 400 is illustrated, wherein FIG. 4A and FIG. 4B illustrate views of the longitudinal directional surface marking 400 from opposite directions. In some embodiments, as illustrated in FIG. 4A, traversing a base surface in a first direction may show a first color 405, such as one that may blend with the base surface. In some embodiments, as illustrated in FIG. 4B, traversing a base surface in a second a direction may show a first directional message 410, such as a symbol indicator that may indicate a vehicle is traversing a roadway in the wrong direction.

In some aspects, the portion of the directional surface marking 400 may comprise a third profile, and the portion that conveys the directional messaging may comprise a first and second profile, such as illustrated and described in FIG. 1A. For example, the first profile may comprise the second color 410 of a red surface color, and both the second and third profiles may comprise the first color 405 of a white surface color, which may allow for viewing of red arrows surrounded by a contrasting white surface in one direction and a plain white surface in the opposite direction. In some embodiments, the third profile may comprise a smooth surface, which may increase the contrast between the profiles, which may further increase visibility of the directional messaging.

In some aspects, the profiles may be manufactured as a single piece. For example, the first and second profiles may be stamped or rolled onto the third profile. In some embodiments, the first and second profiles may be inserted into or adhered onto the third profile. For example, the shapes of the directional messaging may be cut out of the third profile and the portion with the directional messaging may be fitted into the space or recess. As another example, the portion with the first and second profile may be adhered to the portion with the third profile, such as through an adhesive or welding, as non-limiting examples.

Figure 5B:
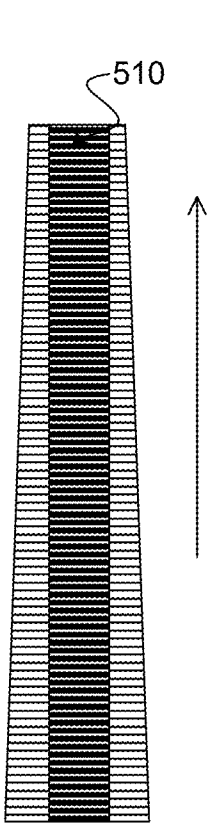
FIG. 5B illustrates a second view of an exemplary longitudinal directional surface marking, wherein the second view may be perceived when a user traverses a base surface in a second direction.
Figure 5A:
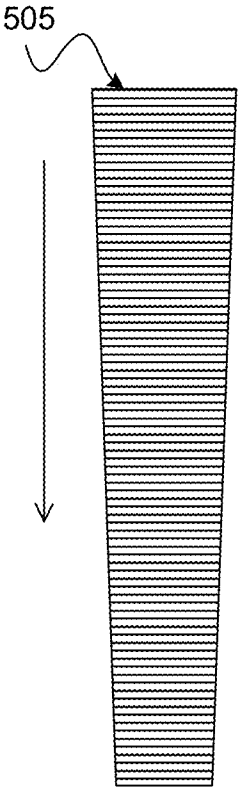
FIG. 5A illustrates a first view of an exemplary longitudinal directional surface marking, wherein the first view may be perceived when a user traverses a base surface in a first direction.

Referring now to FIGS. 5A-5B, an exemplary longitudinal directional surface marking 500 is illustrated, wherein FIG. 5A and FIG. 5B illustrate views of the longitudinal directional surface marking 500 from opposite directions. In some implementations, as illustrated in FIG. 2A, traversing a base surface in a first direction may show a first color 505, such as one that may blend with the base surface. In some embodiments, as illustrated in FIG. 5B, traversing a base surface in a second a direction may show a first directional message 510, such as a color stripe indicator that may indicate a vehicle is traversing a roadway in the wrong direction.

Figure 6A:
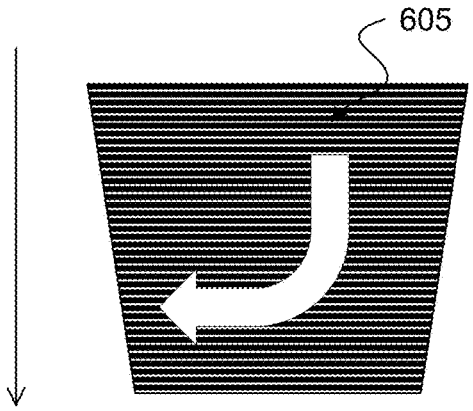
FIG. 6A illustrates a first view of an exemplary directional surface marking, wherein the first view may be perceived when a user traverses a base surface in a first direction.
Figure 6B:
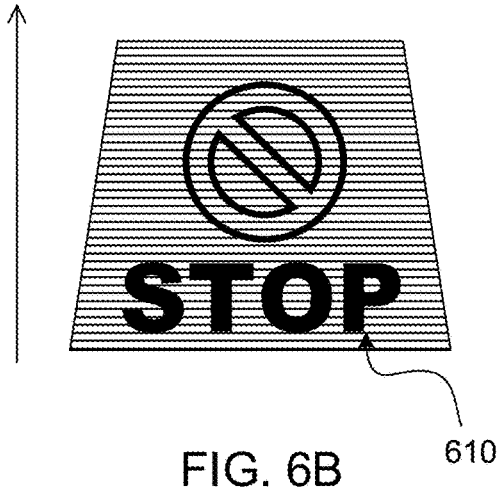
FIG. 6B illustrates a second view of an exemplary directional surface marking, wherein the second view may be perceived when a user traverses a base surface in a second direction.

Referring now to FIGS. 6A-6B, an exemplary directional surface marking 600 is illustrated, wherein FIG. 6A and FIG. 6B illustrate views of the directional surface marking 600 from opposite directions. In some aspects, as illustrated in FIG. 6A, traversing a base surface in a first direction may show a first directional message 605, such as one that may indicate a turn lane against a contrasting background. In some embodiments, as illustrated in FIG. 6B, traversing a base surface in a second a direction may show a second directional message 610, such as a combination of a symbol and text that may indicate a vehicle is traversing a roadway in the wrong direction.

Figure 7A:
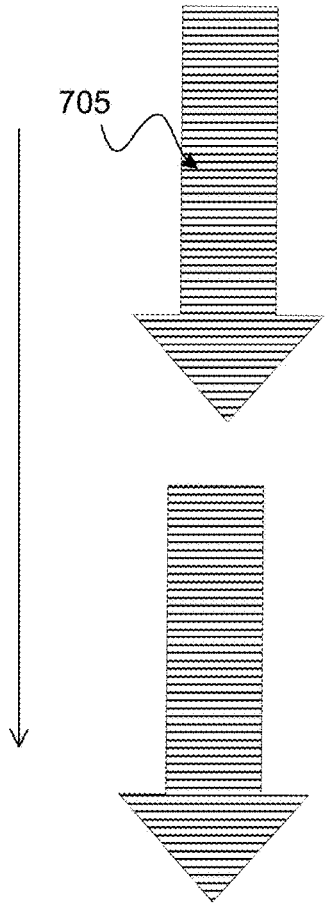
FIG. 7A illustrates a first view of an exemplary arrow directional surface marking, wherein the first view may be perceived when a user traverses a base surface in a first direction.
Figure 7B:
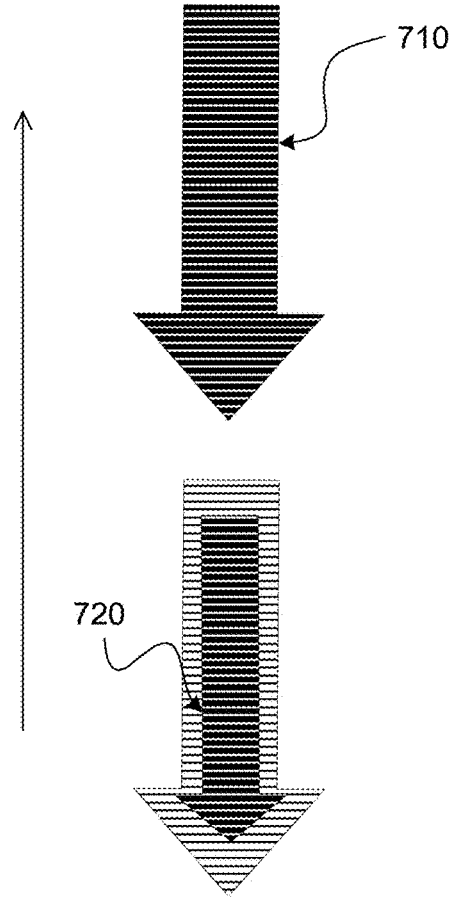
FIG. 7B illustrates a second view of an exemplary arrow directional surface marking, wherein the second view may be perceived when a user traverses a base surface in a second direction.

Referring now to FIGS. 7A-7B, exemplary arrow directional surface markings 700 are illustrated, wherein FIG. 7A and FIG. 7B illustrate views of the directional surface markings 700 from opposite directions. In some aspects, as illustrated in FIG. 7A, traversing a base surface in a first direction may show a first color 705, such as one that may contrast with the base surface. In some embodiments, as illustrated in FIG. 7B, traversing a base surface in a second a direction may show a first directional message 710 and second directional message 720, such as color indicators that may indicate a vehicle is traversing a roadway in the wrong direction.

Figure 8A:
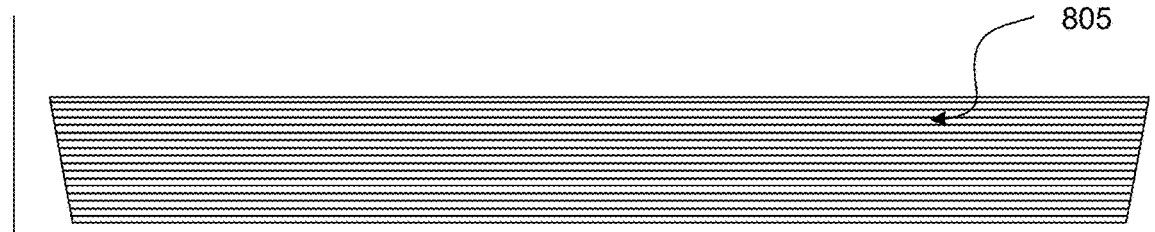
FIG. 8A illustrates a first view of an exemplary lateral directional surface marking, wherein the first view may be perceived when a user traverses a base surface in a first direction.
Figure 8B:
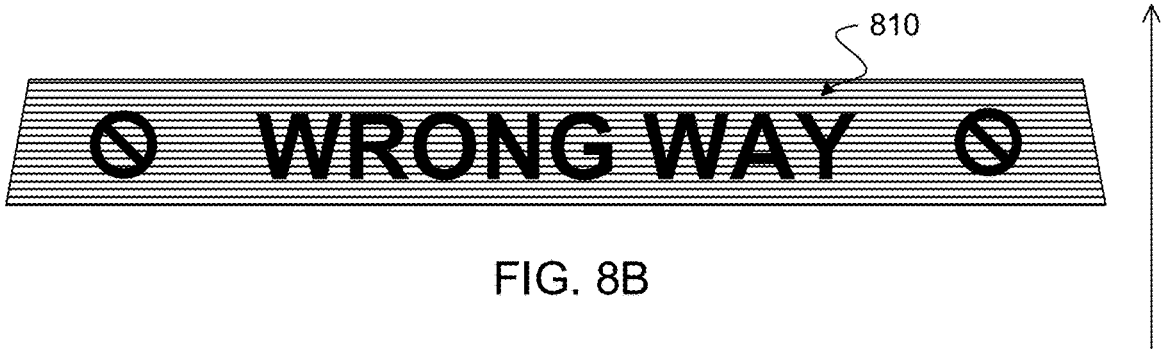
FIG. 8B illustrates a second view of an exemplary lateral directional surface marking, wherein the second view may be perceived when a user traverses a base surface in a second direction.

Referring now to FIGS. 8A-8B, an exemplary lateral directional surface marking 800 is illustrated, wherein FIG. 8A and FIG. 8B illustrate views of the directional surface marking 800 from opposite directions. In some implementations, as illustrated in FIG. 8A, traversing a base surface in a first direction may show a first color 805, such as one that may blend with the base surface. In some embodiments, as illustrated in FIG. 8B, traversing a base surface in a second a direction may show a first directional message 810, such as a combination of symbols and text that may indicate a vehicle is traversing a roadway in the wrong direction.

Figure 9A:
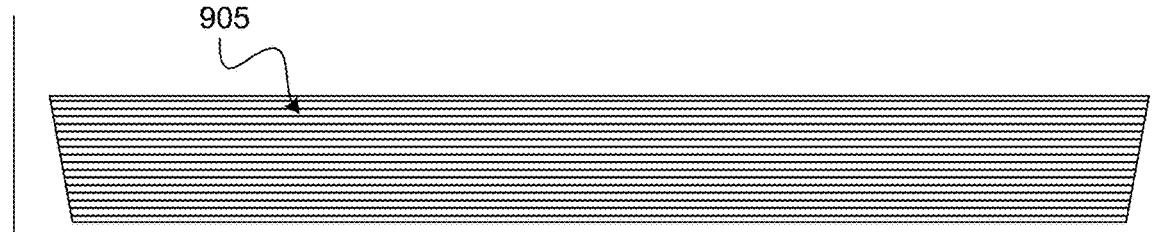
FIG. 9A illustrates a first view of an exemplary lateral directional surface marking, wherein the first view may be perceived when a user traverses a base surface in a first direction.
Figure 9B:
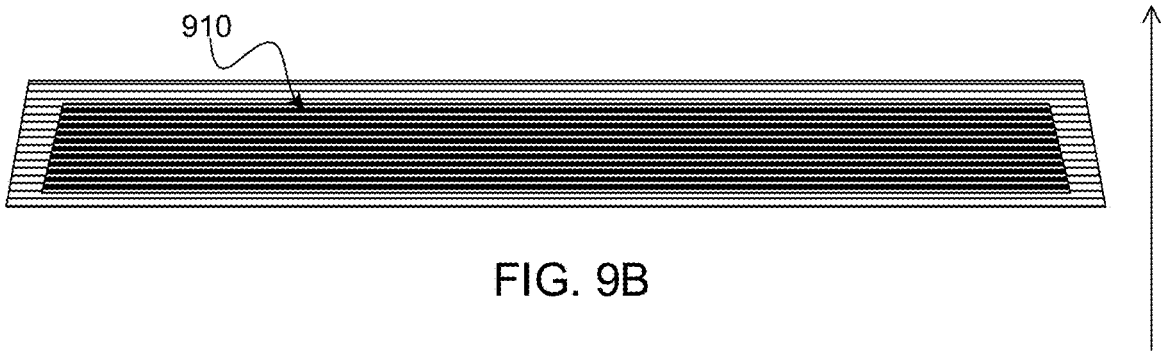
FIG. 9B illustrates a second view of an exemplary lateral directional surface marking, wherein the second view may be perceived when a user traverses a base surface in a second direction.

Referring now to FIGS. 9A-9B, an exemplary lateral directional surface marking 900 is illustrated, wherein FIG. 9A and FIG. 9B illustrate views of the directional surface marking 900 from opposite directions. In some aspects, as illustrated in FIG. 9A, traversing a base surface in a first direction may show a first color 905, such as one that may blend with the base surface. In some embodiments, as illustrated in FIG. 9B, traversing a base surface in a second a direction may show a first directional message 910, such as a color indicator that may indicate a vehicle is traversing a roadway in the wrong direction.

Figure 10A:
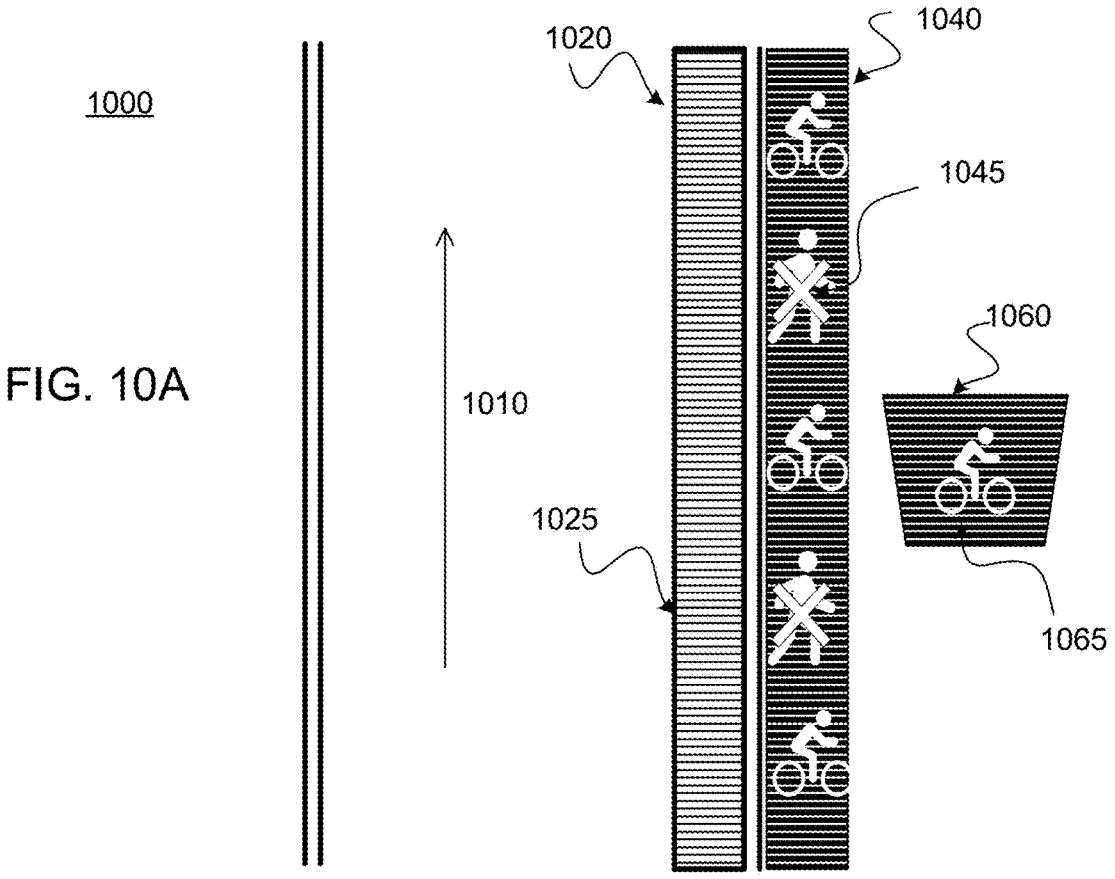
FIG. 10A illustrates a first view of a system of exemplary directional surface markings, wherein the first view may be perceived when a user traverses a base surface in a first direction.
Figure 10B:
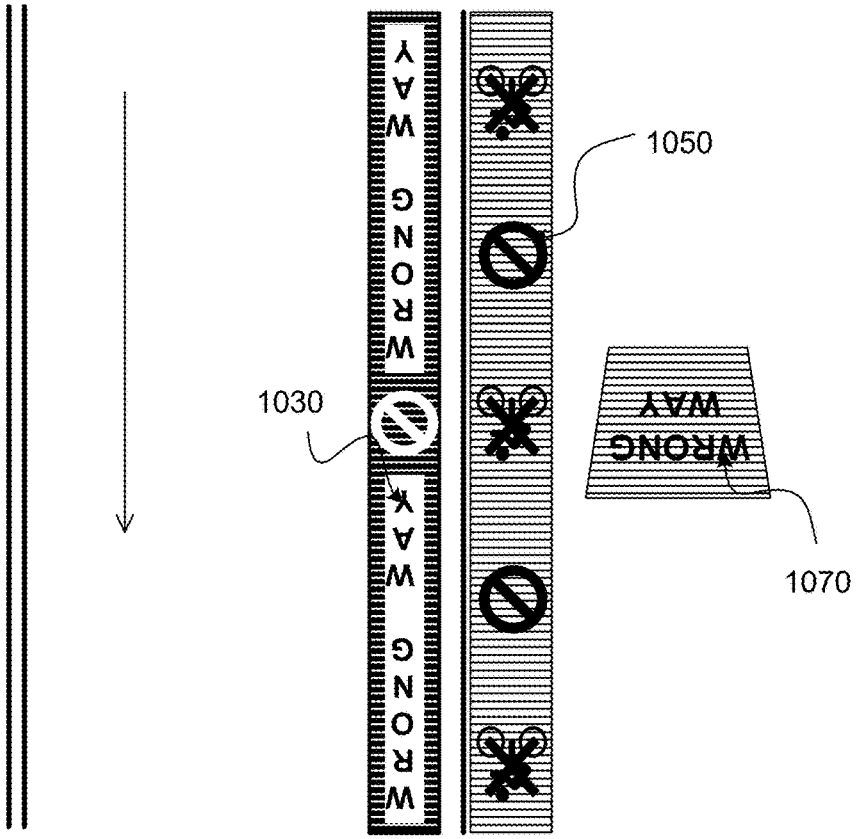
FIG. 10B illustrates a second view of a system of exemplary directional surface markings, wherein the second view may be perceived when a user traverses a base surface in a second direction.

Referring now to FIGS. 10A-10B, an exemplary system 1000 of directional surface markings 1020, 1040, 1060 is illustrated, wherein FIG. 10A and FIG. 10B illustrate views of the directional surface markings 1020, 1040, 1060 from opposite directions. In some aspects, a system 1000 may be integrated into a roadway 1010, wherein a traffic directional surface marking 1020 may comprise directional messaging related to the flow of traffic. For example, for traffic traveling the correct direction down a roadway 1010, a traffic directional surface marking 1020 may comprise a white line 1025 with a contrasting frame, which may allow for guidance of automated vehicles. For traffic traveling the incorrect direction down a roadway 1010, the traffic directional surface marking 1020 may comprise wrong way directional messaging 1030, which may comprise a combination of text and symbols.

In some embodiments, the traffic directional surface marking 1020 may provide additional functionality, such as those related to enhancing safety or providing guidance. For example, the traffic directional surface marking 1020 may provide a vibratory or an auditory alert for vehicles that may be traversing over the traffic directional surface marking 1020, wherein the alert may indicate to a user that they are swerving off the roadway 1010. In some implementations, the profile layer may provide the additional functionality. In some aspects, the profile layer may be configured to allow for different levels of alert based on the direction of travel. For example, the vibratory alert may be stronger for users traveling the wrong way on the roadway 1010.

In some aspects, the system 1000 may comprise a cyclist lane, which may comprise one or more directional surface markings 1040, 1060. In some embodiments, the cyclist directional surface markings 1040, 1060 may provide information about the cyclist lane. For example, a longitudinal cyclist directional surface marking 1040 may be installed in the cyclist lane and a rectangular cyclist directional surface marking 1060 may be installed proximate to the cyclist lane.

In some embodiments, for a cyclist traveling the correct direction with the flow of traffic, the longitudinal cyclist directional surface marking 1040 may comprise a directional message 1045 of symbols that may indicate that the cyclist is allowed in the lane and is traveling the correct direction, and for a cyclist traveling the incorrect direction, the longitudinal cyclist directional surface marking 1040 may comprise a directional message 1050 of symbols that may indicate the cyclist is traveling the incorrect direction. The directional message 1045 may further indicate that pedestrians are not permitted on the cyclist lane. The rectangular cyclist directional surface marking 1060 may comprise similar directional messaging 1065, 1070, wherein a cyclist traveling the correct direction may perceive a cyclist symbol, and a cyclist traveling the incorrect direction may perceive text indicating "wrong way."

Figure 11A:
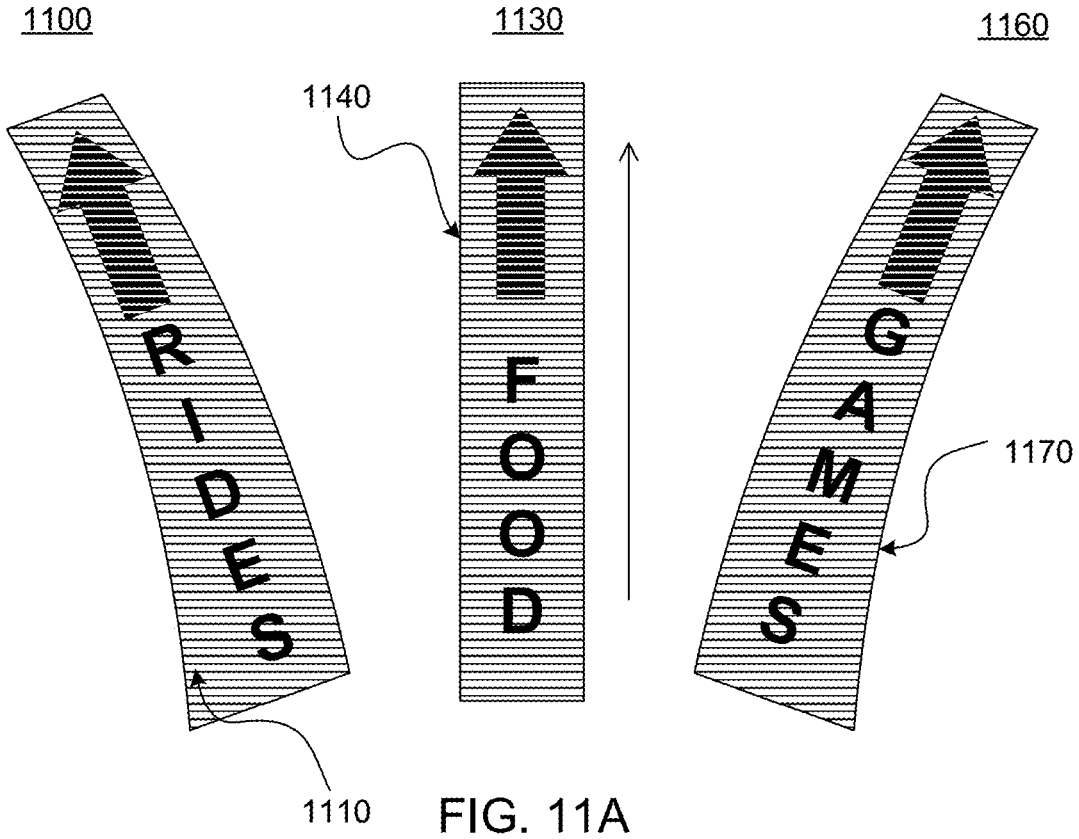
FIG. 11A illustrates a first view of a system of exemplary directional surface markings, wherein the first view may be perceived when a user traverses a base surface in a first direction.
Figure 11B:
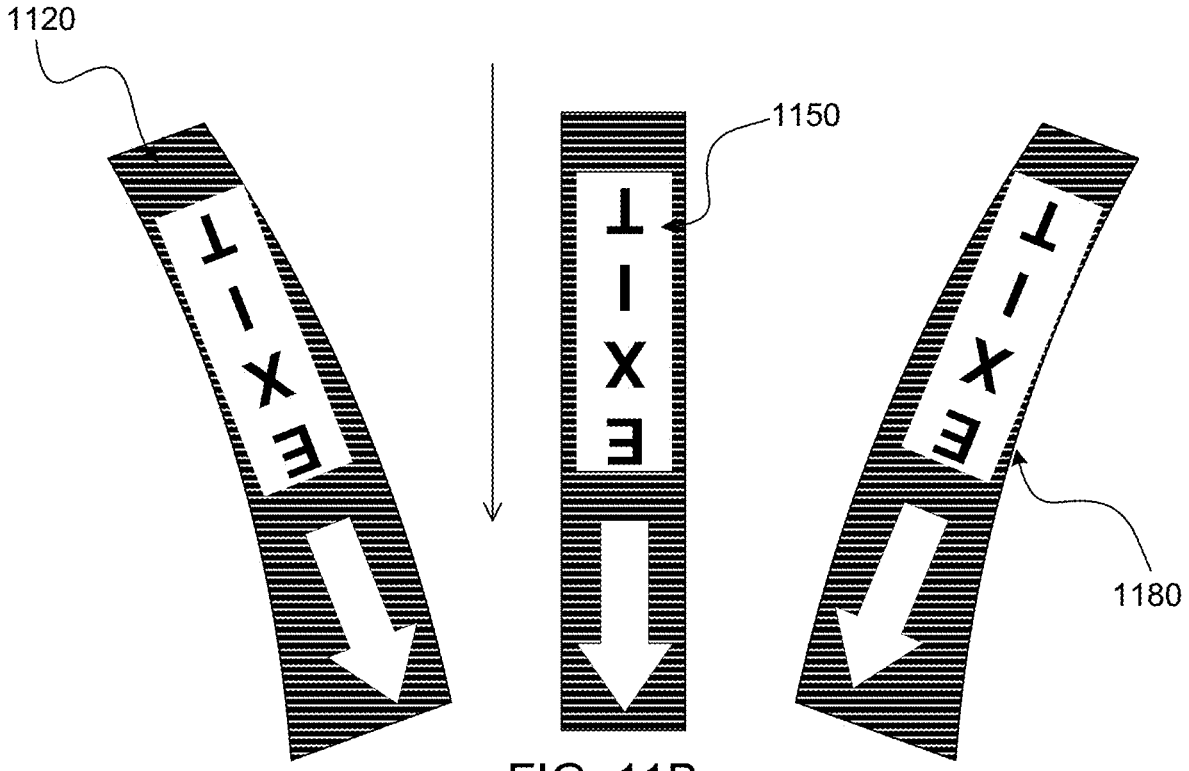
FIG. 11B illustrates a second view of a system of exemplary directional surface markings, wherein the second view may be perceived when a user traverses a base surface in a second direction.

Referring now to FIGS. 11A-11B, an exemplary system of directional surface markings 1100, 1130, 1160 is illustrated, wherein FIG. 11A and FIG. 11B illustrate views of the directional surface markings 1100, 1130, 1160 from opposite directions. In some aspects, directional surface markings 1100, 1130, 1160 may be installed on a pedestrian pathway, such as at an amusement park. In some aspects, a user may be entering an amusement park and wonder which direction they need to travel to reach different areas of the park. In some embodiments, directional surface markings 1100, 1130, 1160 may be installed on the walkway, wherein users may be directed to different parts of the park based on the entrance directional messaging 1110, 1140, 1170. For example, a user may be directed left to reach rides, straight to reach food, and right to reach games.

In some implementations, a user attempting to exit the amusement park may be directed by exit directional messaging 1120, 1150, 1180, wherein the directional surface markings 1100, 1130, 1160 may indicate the exits when a user is traversing the base surface in a direction away from the main areas. In some aspects, the exit directional messaging 1120, 1150, 1180 may comprise a combination of symbols and text, which may clearly provide guidance to users. In some aspects, one or both the exit directional messaging 1120, 1150, 1180 and the entrance directional messaging 1110, 1140, 1170 may be coated in a material that may enhance visibility in low visibility conditions, such as at night, in storms, or in fog, as non-limiting conditions.

Referring now to FIGS. 12A-12B, an exemplary system of directional surface markings 1200, 1220, 1240, 1260 is illustrated, wherein FIG. 12A and FIG. 12B illustrate views of the directional surface markings 1200, 1220, 1240, 1260 from opposite directions. In some aspects, directional surface markings 1200, 1220, 1240, 1260 may be installed on a pedestrian pathway, such as an interior of a hospital. In some embodiments, a user may need to navigate the interior of hospital, wherein each direction may lead to different areas of the hospital, and directional surface markings 1200, 1220, 1240, 1260 may be installed to direct users.

In some embodiments, a mix of longitudinal directional surface markings 1200, 1220, 1240 and rectangular directional surface markings 1260 may be used. In some aspects, the longitudinal directional surface markings 1200, 1220, 1240 may indicate the paths to different areas of the hospital. For example, traveling in a first direction, the directional messaging 1210, 1230, 1250, 1270 may indicate that the first direction may lead to oncology, pediatrics, the emergency room, and a non-emergency exit, such as one that may not be stairwell accessible. Traveling in a second direction, the directional messaging 1215, 1235, 1255, 1275 may indicate that the second direction may lead to obstetrics, cardiology, and an emergency exit.

In some embodiments, emergency exit directional messaging 1255, 1275 may comprise a different color, which may enhance visibility for the paths to emergency exits. In some aspects, each directional message 1210, 1215, 1230, 1235, 1250, 1255, 1270, 1275 may comprise different colors, which may allow for continuity between sections of directional surface markings 1200, 1220, 1240, 1260. For example, the path to obstetrics may be pink, the path to pediatrics may be blue, and any paths to emergency exits may be red. In some aspects, some directional messaging may be coated to allow for enhanced visibility in low visibility conditions, such as a power outage.

Figure 13A:
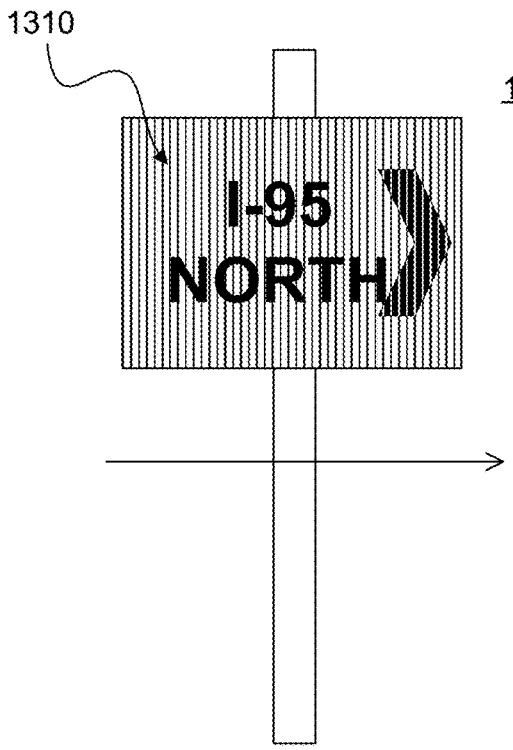
FIG. 13A illustrates a first view of an exemplary vertical directional surface marking, wherein the first view may be perceived when a user traverses a base surface in a first direction.
Figure 13B:
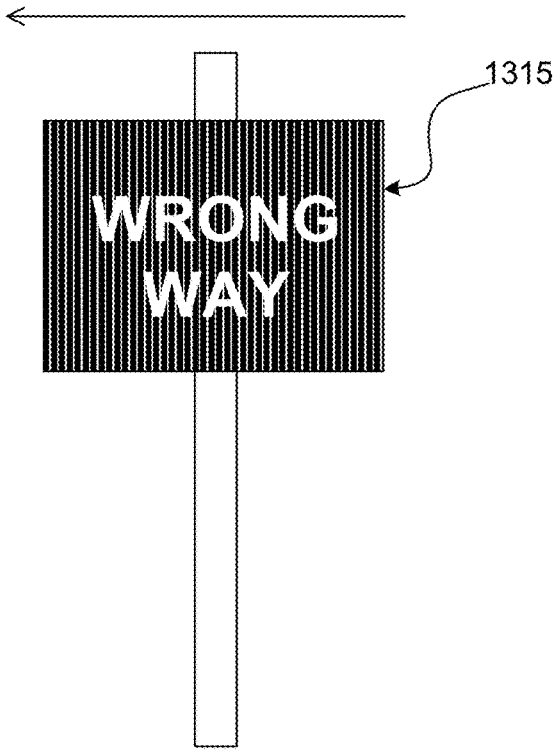
FIG. 13B illustrates a second view of an exemplary vertical directional surface marking, wherein the second view may be perceived when a user traverses a base surface in a second direction.

Referring now to FIGS. 13A-13B, an exemplary vertical directional surface marking 1300 is illustrated, wherein FIG. 13A and FIG. 13B illustrate views of the directional surface marking 1300 from opposite directions. In some aspects, a vertical directional surface marking 1300 may comprise a sign installed perpendicular to a base surface, such as a roadway. For example, the vertical directional surface marking 1300 may be installed at a turn or exit, wherein a user turning correctly onto the exit may view a directional message 1310 that indicates where the exit lead. A user traversing the road in the incorrect direction may view a directional message 1315 that may alert the user they are traveling the "wrong way."

Figure 14A:
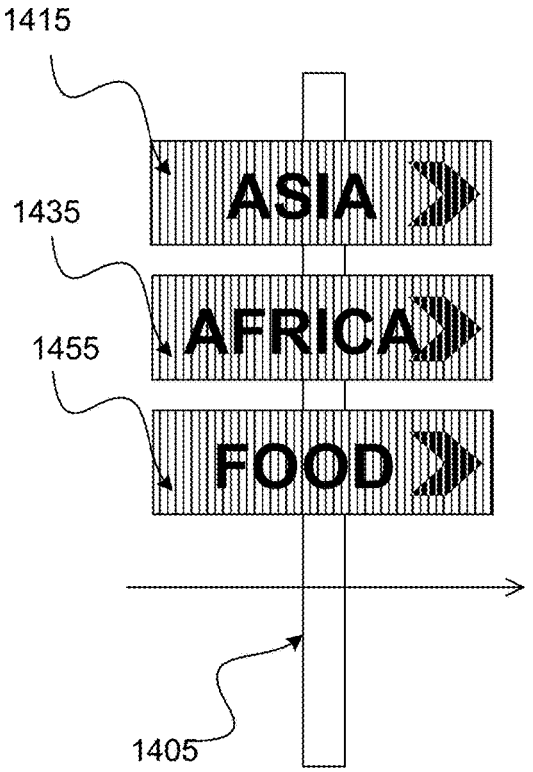
FIG. 14A illustrates a first view of a system of exemplary vertical directional surface markings, wherein the first view may be perceived when a user traverses a base surface in a first direction.
Figure 14B:
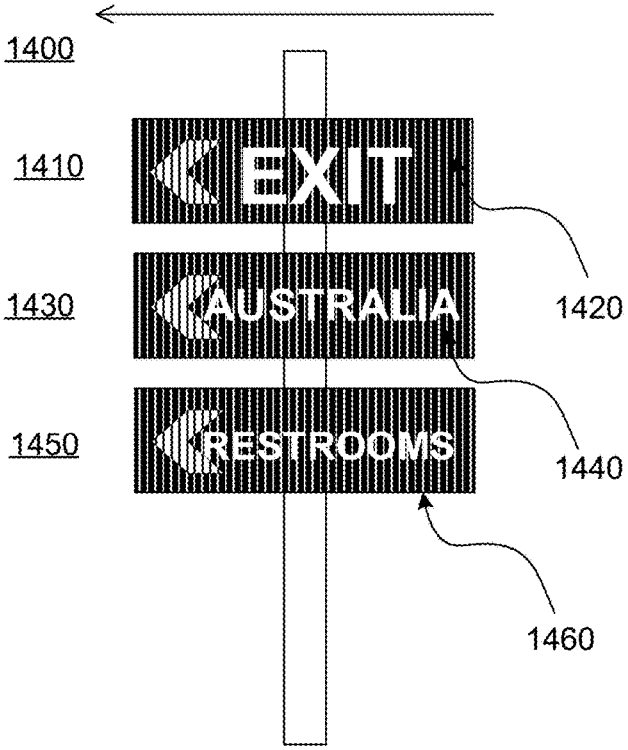
FIG. 14B illustrates a second view of a system of exemplary vertical directional surface markings, wherein the second view may be perceived when a user traverses a base surface in a second direction.

Referring now to FIGS. 14A-14B, an exemplary system 1400 of vertical directional surface markings 1410, 1440, 1470 is illustrated, wherein FIG. 14A and FIG. 14B illustrate views of the directional surface markings 1410, 1440, 1470 from opposite directions. In some aspects, directional surface markings 1410, 1440, 1470 may be installed on a pedestrian pathway, such as a zoo. In some aspects, multiple directional surface markings 1410, 1440, 1470 may be installed on a sign post 1405 that may be placed on a pedestrian pathway, wherein the placement may allow visibility of the directional messaging 1415, 1420, 1435, 1440, 1455, 1460. For example, the system 1400 may be installed parallel at the edge of a pathway, wherein users traversing the pathway in a first direction may view a first directional message 1415, 1435, 1455, such as the directions to an Asia loop, an Africa loop, and to food. Users traversing the pathway in the opposite direction may view a second directional message 1420, 1440, 1460, such as the directions to an exit, an Australian loop, and restrooms.

Figure 15A:
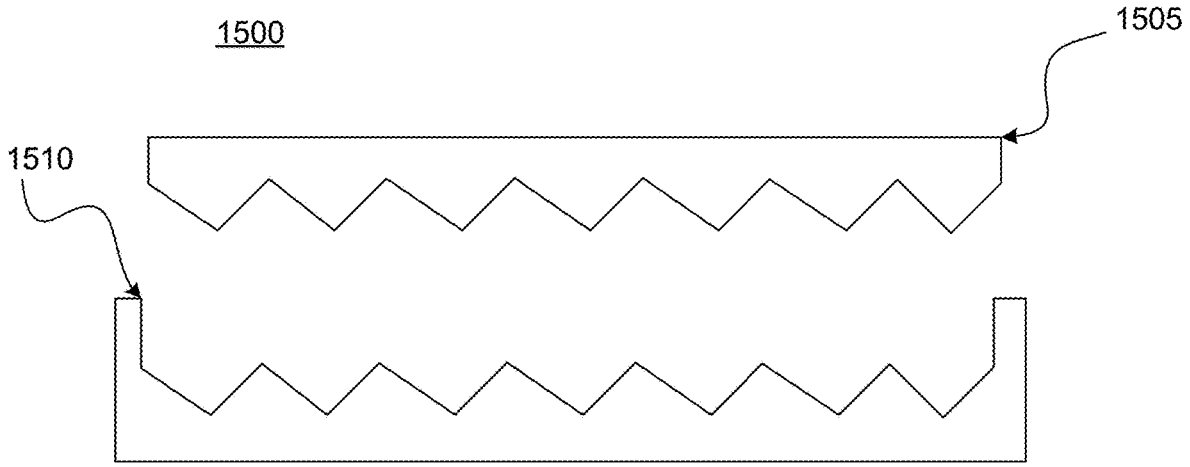
FIG. 15A illustrates an exemplary mold system for manufacturing directional surface markings, according to some embodiments of the present disclosure.
Figure 18:
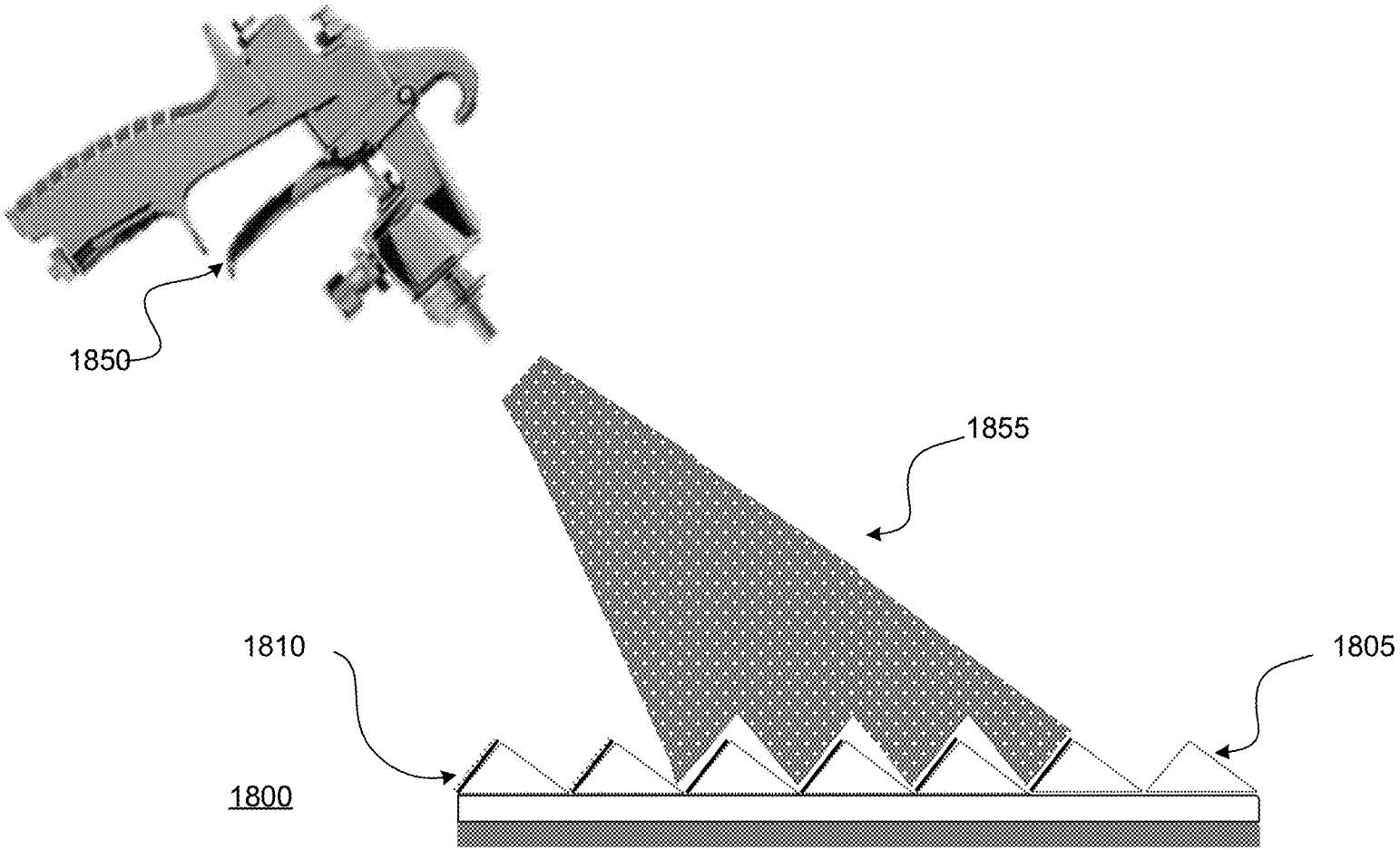
FIG. 18 illustrates an exemplary painting mechanism for applying paint to directional surface markings, wherein an application of paint to a first profile may add directional messaging.

Referring now to FIG. 15A, an exemplary mold system 1500 for manufacturing directional surface markings 1520, 1530 is illustrated. In some aspects, a mold system 1500 may comprise an upper mold 1505 and a lower mold 1510. In some embodiments, the molding process may comprise pouring in a material between the upper mold 1505 and the lower mold 1510 and then curing the material until hardened. In some implementations, the cured material may be pulled from the mold system 1500 and then finished. In some aspects, finishing may comprise refining the profile layer, wherein refining may result in clean profiles. In some embodiments, the cured material may be attached to other layers, such as illustrated in FIG. 1A. In some aspects, the cured material may be coated, such as illustrated in FIG. 18.

Figure 15B:
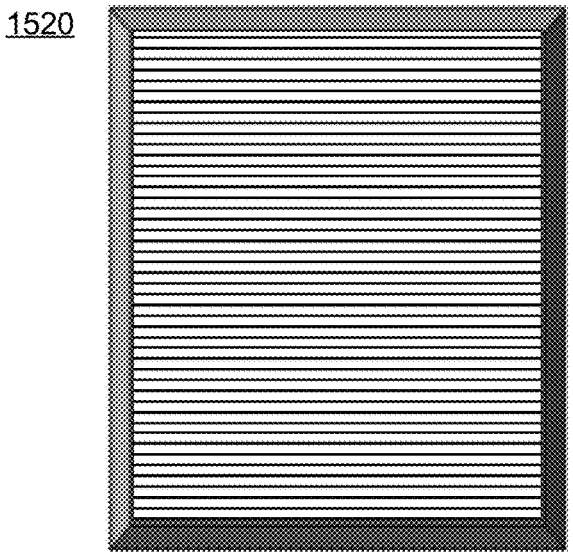
FIG. 15B illustrates an exemplary directional surface marking, wherein the directional surface marking may be manufactured from a mold system.
Figure 15C:
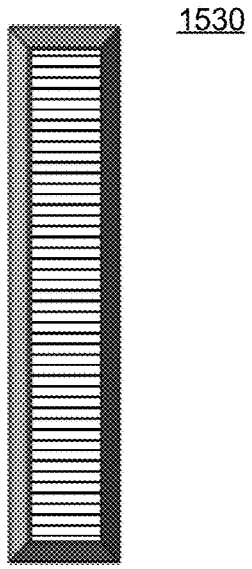
FIG. 15C illustrates an exemplary directional surface marking, wherein the directional surface marking may be manufactured from a mold system.

Referring now to FIG. 15B-15C, exemplary directional surface markings 1520, 1530 are illustrated, wherein the directional surface markings 1520, 1530 may be manufactured from a mold system 1500. In some aspects, the directional surface markings 1520, 1530 may be manufactured utilizing a material that may provide a base color, wherein the base color may the intended color for at least one of the profiles of the directional surface markings 1520, 1530. In some implementations, the mold system 1500 may be set to manufacture specific sized directional surface markings 1520, 1530, such as a longitudinal directional surface marking 1530 or lateral directional surface marking 1520.

Figure 16:
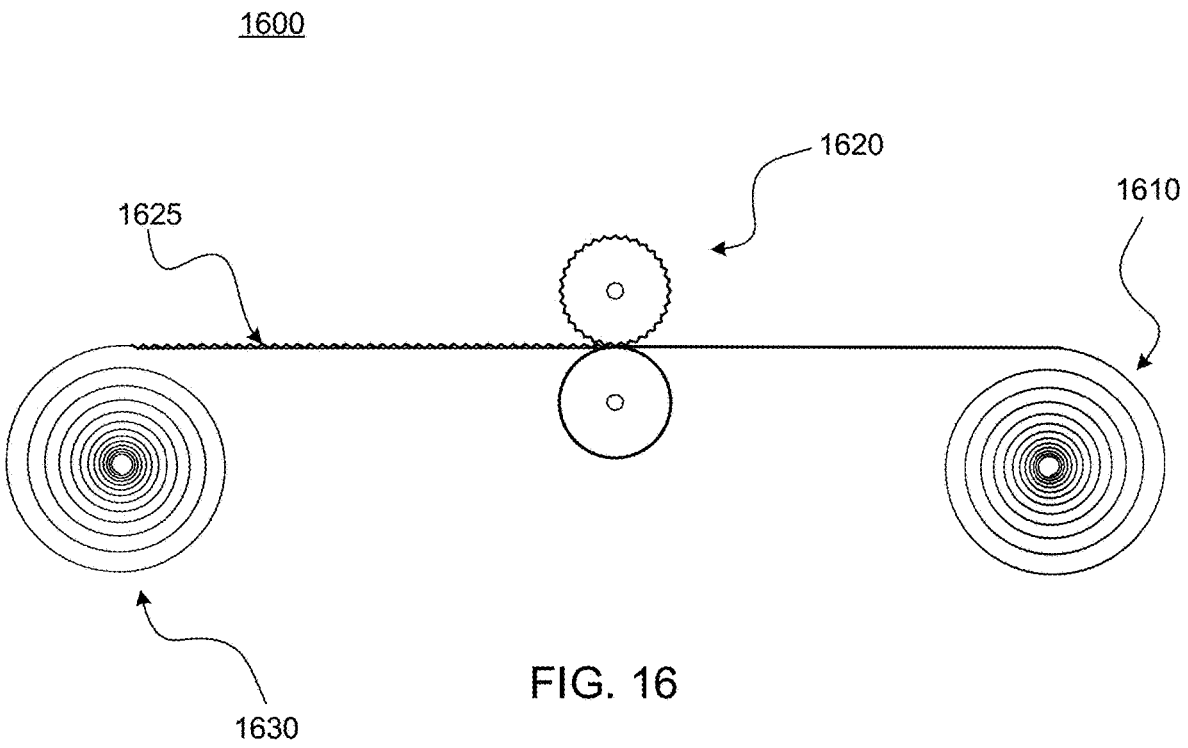
FIG. 16 illustrates an exemplary calendaring system, wherein the calendaring system may be used to manufacture directional surface markings.

Referring now to FIG. 16, an exemplary calendaring system 1600 is illustrated, wherein the calendaring system 1600 may be used to manufacture directional surface markings. Typically, calendaring is a manufacturing process of smoothing and compressing a material during production by passing a single continuous sheet 1610 through one or more pairs of heated rolls 1620, wherein the heated rolls 1620 in combination are called calendars. In some aspects, the heated rolls 1620 may be constructed of steel with a hardened surface or steel covered with fiber. In some embodiments, one of the heated rolls 1620 may comprise a profiling surface, wherein when the continuous sheet 1610 passes through the heated rolls 1620, at least one surface 1625 may comprise a profile layer. In some implementations, a processed sheet 1630 may be rolled, which may allow for customized sizing for installation.

Figure 17:
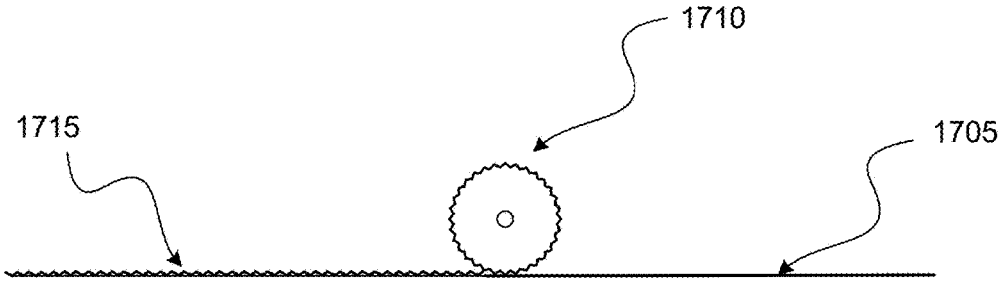
FIG. 17 illustrates an exemplary roller, wherein the roller may be used directly on a base surface to create directional surface markings.

Referring now to FIG. 17, an exemplary roller 1710 is illustrated, wherein the roller 1710 may be used directly on a base surface 1705 to create directional surface markings. In some aspects, a roller 1710 may be attached to a vehicle that may drive over the base surface 1705, wherein the roller 1710 may add one or more profiles to the base surface 1705. In some implementations, the base surface 1705 may be wet or only partially set, which may allow the roller 1710 to effectively imprint the base surface 1705 with a profile layer 1715.

Referring now to FIG. 18, an exemplary painting mechanism 1850 for applying paint 1855 to directional surface markings 1800, wherein an application of paint 1855 to a first profile 1810 may add directional messaging. In some embodiments, the painting mechanism 1850 may spray paint 1855 at a specific angle and direction, wherein an application of paint 1855 may be applied to the first profile 1810 with limited to no overspray onto a second profile 1805. In some aspects, a painting mechanism 1850 may be used to spray both profiles 1810, 1805, such as with different color paints, different directional messaging, or a coating that may be applied to both. In some aspects, the coating may be applied by spray, brush, roll, or print, as non-limiting examples.

In some implementations, directional messaging may be added through a stenciling method. In some aspects, a stencil of the directional message may comprise the same or similar material to the directional surface marking 1800, wherein the surface of the stencil may comprise opposite profiles to the directional surface marking 1800. In some embodiments, placing the stencil over the directional surface marking 1800 may limit or reduce the chance of a coating leaking, seeping, dripping, or over spraying onto the wrong profile. In some aspects, once the coating is applied, the stencil may be removed, leaving the directional message on the correct profile.

Figure 19A:
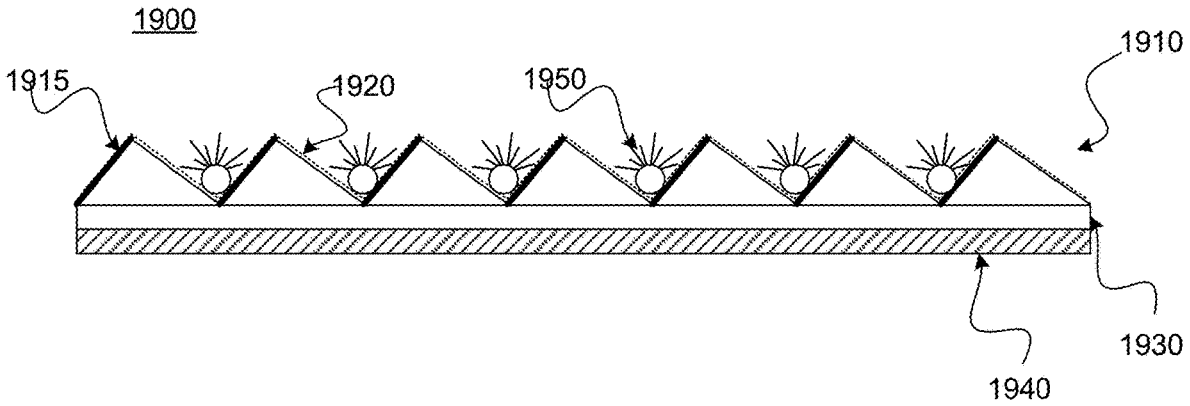
FIG. 19A illustrates a cross section of an exemplary directional surface marking, according to some embodiments of the present disclosure.
Figure 19B:
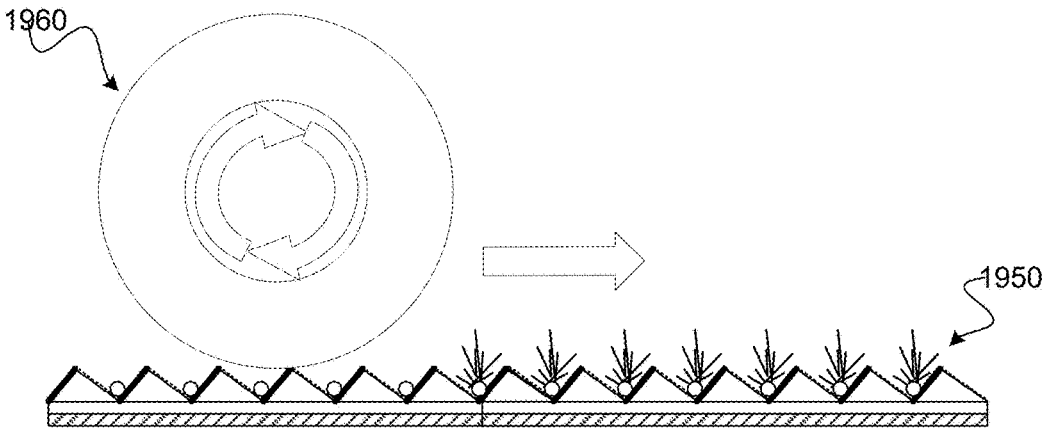
FIG. 19B illustrates a cross section of an exemplary directional surface marking, according to some embodiments of the present disclosure.

Referring now to FIGS. 19A-19B, a cross section of an exemplary directional surface marking 1900 is illustrated. In some aspects, a directional surface marking 1900 may comprise a profile layer 1910 as an upper layer, wherein the profile layer 1910 may comprise a first profile 1915 and a second profile 1920. In some embodiments, the directional surface marking 1900 may comprise one or more illumination sources 1950, which may provide an increase in visibility of one or more the profile layer 1910, the base surface, surrounding surface markings or markers, as non-limiting examples. Illumination sources 1950 may increase visibility where visibility may be low, such as at night, during a power outage, in a storm, as non-limiting examples.

In some aspects, the illumination sources 1950 may comprise a series of strips that may be positioned between the topography of the directional surface marking 1900, such as in the valleys between the peaks. In some implementations, the illumination sources 1950 may be visible in one or more directions. In some embodiments, the illumination sources 1950 may comprise a connected or disconnected series of lights, light strips, light netting, or bulbs. In some aspects, the illumination sources 1950 may be actively or passively powered, such as by solar power, thermal power, or wired from an external power source. In some embodiments, the illumination sources 1950 may be integrated with the profile layer 1910, which may occur during manufacture, after manufacture, during installation, or after installation.

In some aspects, the profile layer 1910 may be coated with a paint or material that may enhance one or more characteristics of the directional surface marking 1900, such as visibility or durability, as non-limiting examples. For example, the profile layer 1910 may be coated with a retroreflective material, which may enhance visibility of the profile layer 1910 where the base surface may be traversed by vehicles or users with portable lighting. In some implementations, the profile layer 1910 may comprise a material that may absorb or reflect light, which may allow for an adjustment of the illumination strip.

In some aspects, the surface color sets of the profile layer 1910 may be the same or different for each direction. In some embodiments, the surface color sets may provide the directional messaging. In some implementations, the first and second profiles may comprise different materials or coatings, wherein each material or coating may comprise different light absorption levels. For example, a wrong-way message may absorb a specific range of visible wavelengths as a way to control how users may view the directional messaging.

In some aspects, the angles and height of the first and second profile may depend on the use. In some embodiments, the angle and height may be based on increasing the effectiveness of the illumination. For example, the angle may direct light from the illumination source 1950 to one of the profile layers, 1915, 1920. As another example, the angle may affect light from the illumination source 1950 to reduce glare for oncoming drivers.

In some embodiments, the profile layer 1910 may comprise a flexible material, such as a polymeric, rubber, epoxy, or acrylic, as non-limiting examples. In some implementations, at least a portion of the profile layer 1910 may comprise a rigid material, such as a cement, asphalt, glass, or other rigid material. In some implementations, directional surface markings 1900 may comprise a plurality of layers. In some embodiments, the directional surface markings 1900 may comprise a conformance layer 1930 and an adhesive layer 1940. In some aspects, one or both the conformance layer 1930 and the adhesive layer 1940 may comprise a heating mechanism, such as an active heater, a thermal material, or positive temperature coefficient material, as non-limiting examples. A heating element may limit the accumulation of ice or snow, which may reduce the effectiveness of the directional surface marking 1900.

In some embodiments, the directional surface marking 1900 may receive sensor data, such as from sensors within the directional surface marking 1900 or remote sources. Remote sources may include proximate traffic lights, buried communication lines, or street sign sensors, as non-limiting examples. In some aspects, the sensors may comprise pressure sensors, such as may be embedded in the directional surface marking 1900, such as within either or both the conformance layer 1930 or the adhesive layer 1940.

In some embodiments, the sensors may comprise light sensors, such as may be located between the high and low points of the topography. Sensors may recognize when a vehicle is traversing the base surface and may be able to sense direction. In some aspects, where sensors may identify direction, the illumination sources 1950 may be responsive to the direction. For example, at night, the illumination sources 1950 may be dark, constantly lit, or dimly lit, and when a vehicle 1960 traverses the base surface in the wrong direction, the illumination sources 1950 may light up, flash, or become more vibrant.

In some aspects, the illumination sources 1950 may comprise more than one lighting type. For example, the illumination sources 1950 may comprise a passive lighting mechanism, such as UV absorbing material that may glow when light is low, and an active lighting mechanism, such as LEDs, that may be activated under predefined conditions. Multiple lighting mechanisms may provide more effective and energy efficient lighting for the directional surface marking 1900.

Figure 20A:
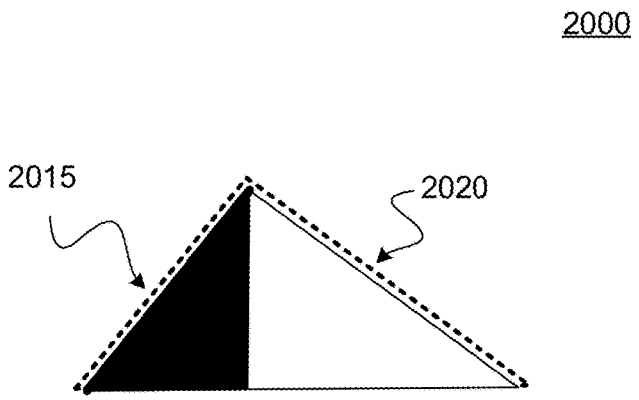
FIG. 20A illustrates a cross section of an exemplary directional surface marking, according to some embodiments of the present disclosure.
Figure 20B:
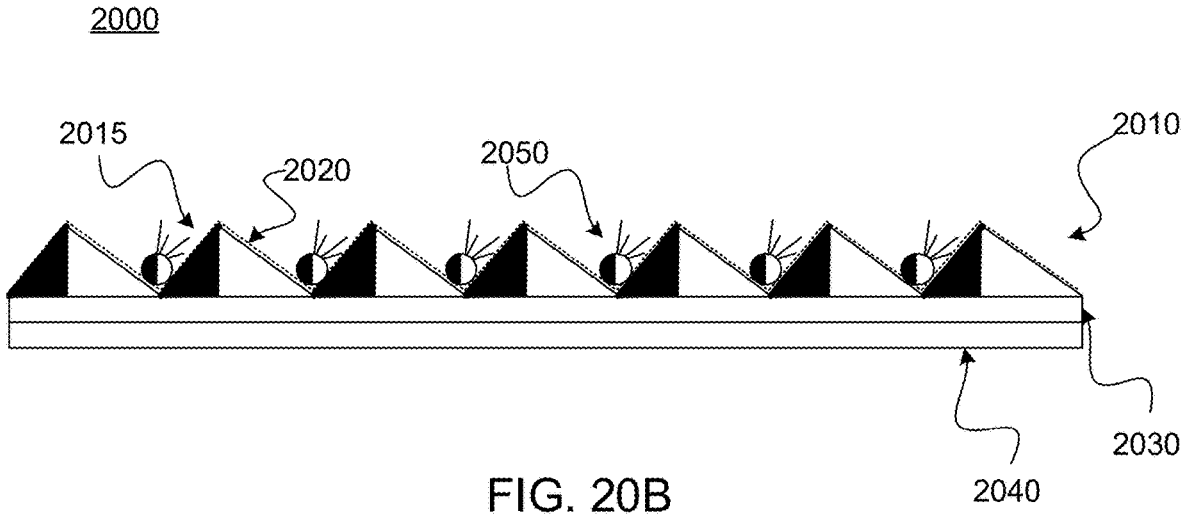
FIG. 20B illustrates a cross section of an exemplary directional surface marking, according to some embodiments of the present disclosure.

Referring now to FIGS. 20A-20B, a cross section of an exemplary directional surface marking 2000 is illustrated. In some aspects, a directional surface marking 2000 may comprise a profile layer 2010 as an upper layer, wherein the profile layer 2010 may comprise a first profile 2015 and a second profile 2020. In some embodiments, the directional surface marking 2000 may comprise one or more illumination sources 2050, which may provide an increase in visibility of one or more the profile layer 2010, the base surface, surrounding surface markings or markers, as non-limiting examples. In some embodiments, the directional surface markings 2000 may comprise a conformance layer 2030 and an adhesive layer 2040, which may provide attachment mechanisms to connect the directional surface marking 2000 to a base surface.

In some aspects, the first profile 2015 may comprise a first color, and the second profile 2020 may comprise a second color. In some embodiments, the colors may be integrated with the material of the profile layer 2010. In some implementations, the color may be injected into the profile layer 2010 in a pattern to create the directional messaging. For example, each half of the topography of the profile layer 2010 may comprise a different color. In some embodiments, the color may be integrated into the material, such as during manufacturing.

In some embodiments, the directional surface marking 2000 may comprise illumination sources 2050, which may provide lighting. In some aspects, the illumination sources 2050 may comprise strips of low-power lights, such as LEDs. In some implementations, the illumination sources 2050 may direct lighting toward one of the profiles 2015, 2020. For example, a portion of the illumination sources 2050 may be obscured, limiting lighting for one side. Directed lighting may allow for an emphasis and highlighting of one of the profiles 2015, 2020 such as wrong direction messaging.

In some aspects, the illumination sources 2050 may be located throughout the directional surface marking 2000. In some embodiments the illumination sources 2050 may be located within the directional surface marking 2000 to highlight the directional messaging, such as around the outline of the directional messaging or illuminating a portion of the directional messaging. For example, illumination sources 2050 may light a directional arrow and allow ambient light to make the text visible. In some aspects, illumination sources 2050 may be bright and inhibit the legibility of text if placed throughout the entire directional surface marking 2000.

In some embodiments, illumination sources may be varied through the directional surface marking 2210, 2220. For example, text may comprise glowing illumination sources, and symbols may comprise responsive flashing illumination sources. As another example, the entire directional messaging may comprise a glowing illumination, and a portion may comprise alert type illumination sources, which may be flashing, bright, or colored.

Figure 21A:
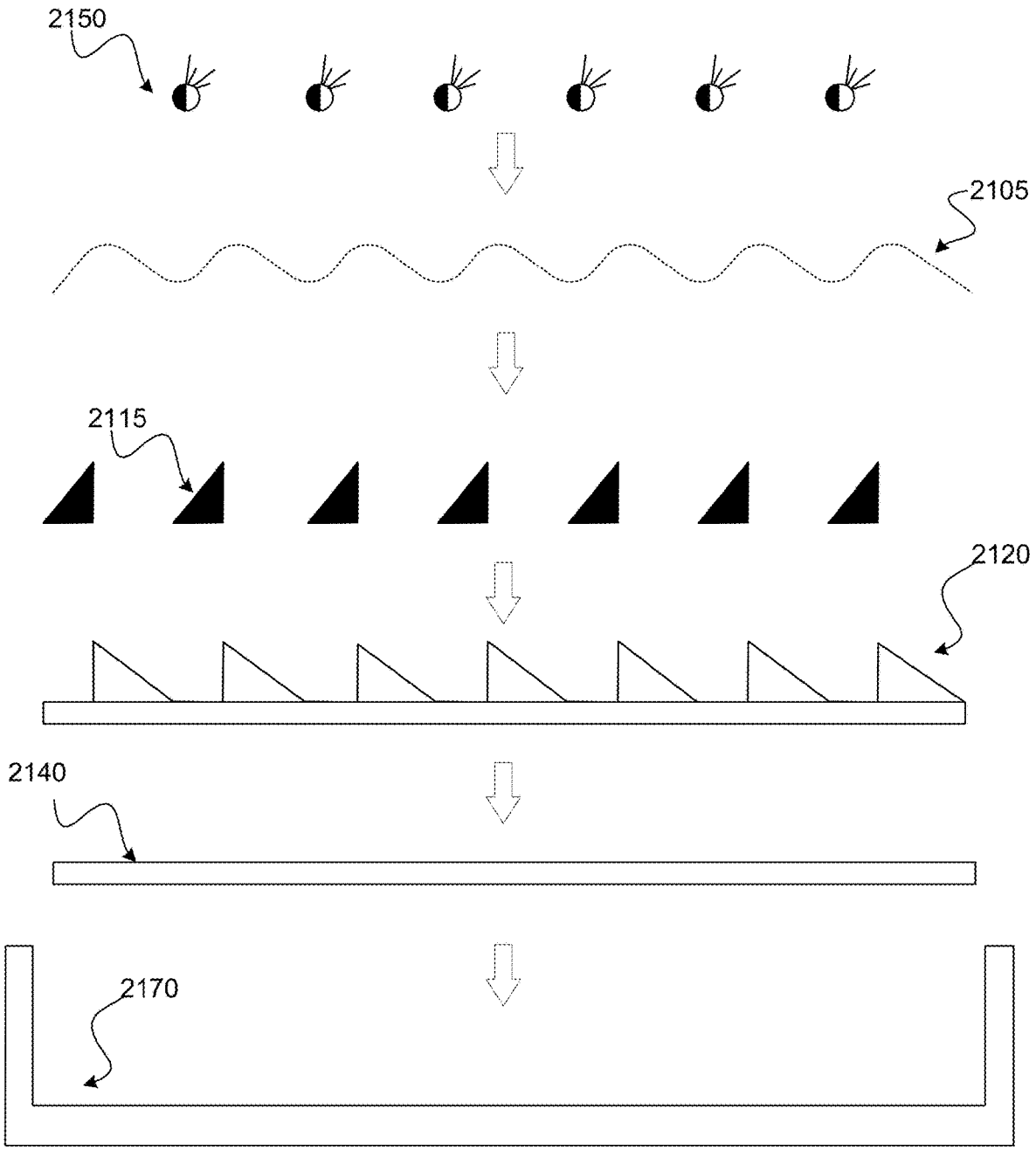
FIG. 21A illustrates a layering installation of an exemplary directional surface marking, according to some embodiments of the present disclosure.
Figure 21B:
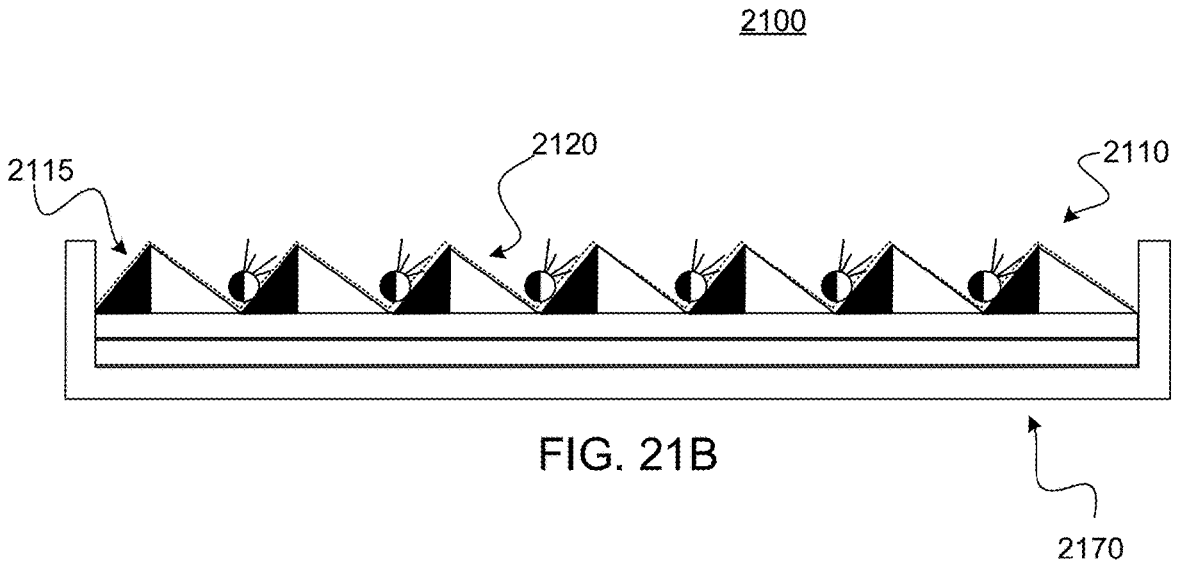
FIG. 21B illustrates a cross section of an exemplary directional surface marking, wherein the directional surface marking may be embedded within the base surface.
Figure 21C:
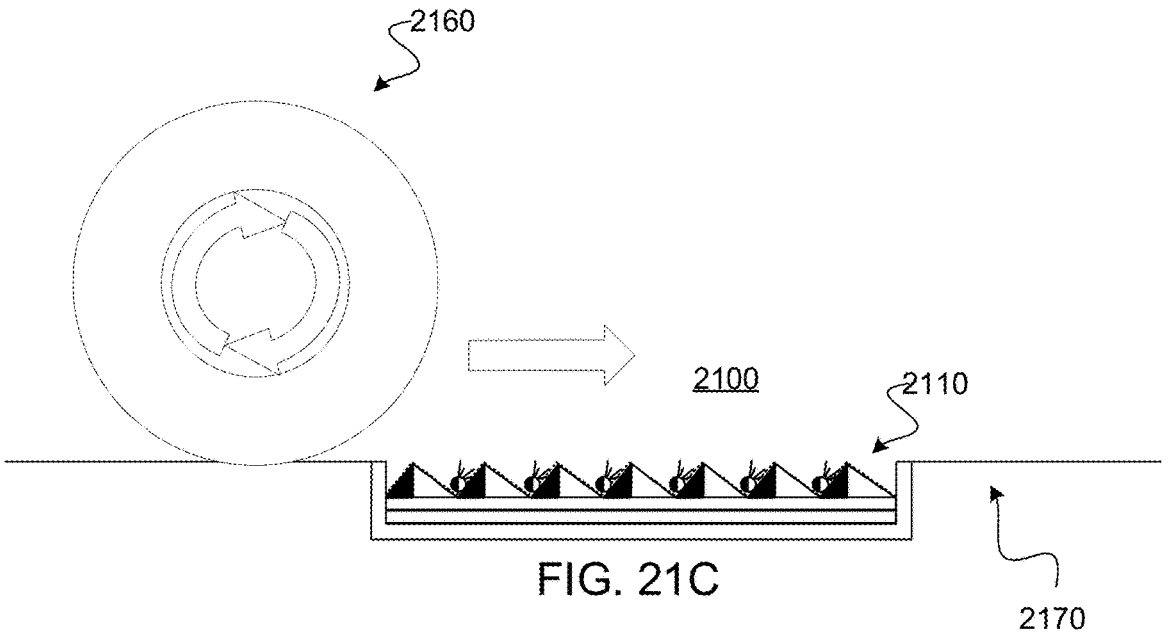
FIG. 21C illustrates a cross section of an exemplary directional surface marking, wherein the directional surface marking may be embedded within the base surface.

Referring now to FIG. 21A, exemplary layering installation of an exemplary directional surface marking 2100 is illustrated, and to FIGS. 21B-21C, a cross section of an exemplary directional surface marking is illustrated, wherein the directional surface marking 2100 may be embedded within the base surface 2170, such as a roadway or walkway. In some aspects, a portion of the layers of the directional surface marking 2100 may be manufactured remotely and installed on site, such as directly onto a base surface 2170. In some embodiments, a portion of the layers may be manufactured on site. For example, a portion of the profile layer 2110 may be stamped or rolled directly onto the base surface 2170 or directly onto a layer above the base surface 2170.

In some aspects, a sealing layer 2105 may be added to one or more surfaces of the profile layer 2110 and the illumination sources 2150. In some embodiments, the sealing layer 2105 may provide protection and increase durability of the layers most susceptible to the elements. In some implementations, the sealing layer 2105 may protect the illumination sources 2150 and may adhere the illumination sources 2150 to the profile layer 2110. The sealing layer 2105 may be added during installing, during manufacture, or after either. As non-limiting examples, the sealing layer 2105 may comprise a resin, sealants, or epoxy.

In some aspects, the sealing layer 2105 may be a coating, which may be applied in a variety of methods, such as spraying, rolling, or pouring. In some implementations, the sealing layer 2105 may comprise a transparent or semi-transparent material that may be layered over one or both the profile layer 2110 and the illumination sources 2150. In some embodiments, the sealing layer 2105 may overlap with the base surface 2170, which may limit any access or damage to the directional surface marking 2100. In some implementations, the sealing layer 2105 may be poured to create a smooth surface over the profile layer 2110, which may increase the durability of the directional surface marking 2100.

In some embodiments, the topography of the profile layer 2110 may comprise a combination of a first topography of the first profile layer 2115 and a second topography of the second profile layer 2120. In some aspects, the different color portions may comprise different material. For example, the different materials may be selected based on their ability to maintain their respective color. As another example, the different materials may be selected to increase longevity and durability of the directional surface marking 2100.

In some aspects, the second profile layer 2120 may comprise a congruous segment of material, such as a sheet, roll, or tile, and the first profile layer 2115 may comprise a series of pieces that may be assembled onsite or prior to installation. In some embodiment, both profile layers 2115, 2120 may be a congruous segment or a series of pieces. In some implementations, the construction of the profile layer 2115, 2120 may depend on a range of factors, such as installation preferences, installation constraints, manufacturing preferences, manufacturing constraints, costs, directional messaging, or base surface types, as non-limiting examples. In some embodiments, a congruous segment may be constructed of one or more materials, which may formed through rolling, stamping, or injection molding, as non-limiting examples.

In some embodiments, each profile layer 2115, 2120 may comprise a solid or congruous piece or multiples pieces that may be combined to form the profile layer 2115, 2120. In some aspects, having a first profile layer 2115 for a first profile and second profile layer 2120 for a second layer may allow for a range of manufacturing techniques. In some aspects, having a first profile layer 2115 for a first profile and second profile layer 2120 for a second layer may allow for easier replacement and repair of damaged portions of the directional surface marking 2100.

In some aspects, an adhesive layer 2140 may allow for installation of the directional surface markings 2100 into a base surface. For example, the directional surface markings 2100 may be attached through adhesive bonding, thermal bonding, or mechanically fastened, as non-limiting examples. In some embodiments, the method of installation may depend on the base surface, such as a concrete walkway, an asphalt roadway, or interior flooring, as non-limiting examples.

In some embodiments, the layers of the directional surface marking 2100 may be manufactured through one or more manufacturing techniques, such as compression, calendaring, extrusion, injection, transfer, or 3D printing, as non-limiting examples. In some implementations, the method of manufacture may depend on the application, such as the type of base surface, as installing directional surface markings 2100 on top of a cement or concrete pathway in Southern Florida may have different requirements than embedded in an asphalt roadway in upstate New York. For example, the humidity levels would vary drastically between the two locations, which may help inform the best method of installation. As another example, an asphalt roadway in upstate New York would likely need to be ploughed for snow on occasion, which would make the directional surface marking 2100 susceptible to damage from the plough.

In some implementations, the directional surface marking 2100 may be installed to embed within the base surface 2170, which may limit the contact between the directional surface marking 2100 and vehicles 2160 traversing the base surface 2170. In some embodiments, embedding the directional surface marking 2100 within the base surface 2170 may allow for a smoother drive over the directional surface marking 2100. In some aspects, the base surface 2170 may be poured to include the necessary divots to fit the directional surface marking 2100. In some embodiments, the divots or recesses may be created during installation of the directional surface marking 2100.

Figure 22:
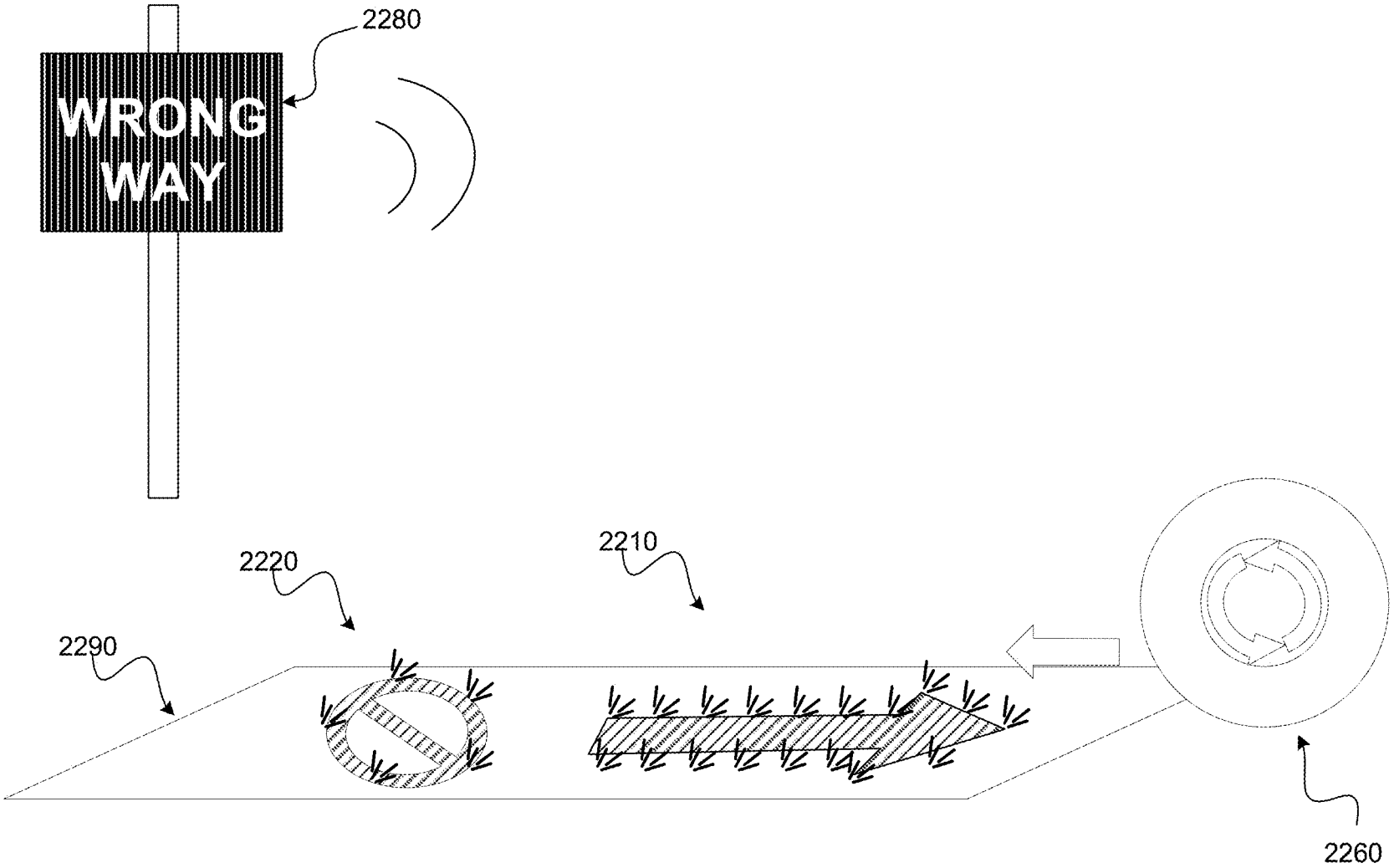
FIG. 22 illustrates exemplary directional surface markings on a base surface, according to some embodiments of the present disclosure.

Referring now to FIG. 22, exemplary directional surface markings 2220, 2210 on a base surface is illustrated. In some aspects, one or more of the directional surface markings 2220, 2210 may receive wireless or wired communication from a proximate roadway sign 2280. The communication may indicate when a vehicle 2260 is traversing the base surface in the wrong direction. In some embodiments, the communication may prompt a predefined action of the illumination sources, such as lighting, flashing, or increasing intensity, as non-limiting examples.

In some aspects, the directional surface markings 2220, 2210 may comprise a combination of passive and active lighting. For example, the illumination sources may glow until a notification of a wrong-way driver is received, which may cause the illumination sources to illuminate, flash, or flash then stay illuminated, as non-limiting examples of lighting patterns. In some embodiments, the wrong way status may continue until the wrong way communication is terminated. For example, the sensors may be able to identify when the vehicle 2260 rights itself. In some embodiments, the communications may be received from pre-existing base surface sensors, such as through a loop system or radar, as non-limiting examples. In some embodiments, the directional surface markings 2220, 2210 may be integrated within a sheet 2290, which may enhance the visibility of the directional surface markings 2220, 2210. In some aspects, the sheet 2290 may comprise a smooth surface that may contrast with the profile layer of the directional surface markings 2220, 2210. In some implementations, the directional surface markings 2220, 2210 may be embedded or attached to the sheet 2290 prior to installation, such as during manufacturing. In some embodiments, the sheet 2290 and the directional surface markings 2220, 2210 may be manufactured together, such as through coextrusion. In some aspects, the shapes of the directional surface markings 2220, 2210 may be cut out from the sheet 2290 allowing for the insertion of the directional surface markings 2220, 2210. The segments may be attached, such as through an adhesive or welding, as non-limiting examples,

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combinations or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A directional surface marking device comprising:

a profile layer installable parallel to a base surface, wherein, when installed, a topography of the profile layer allows for at least a first directional messaging and a second directional messaging, the profile layer comprising at least:

a first profile comprising a first set of surface colors providing a first directional messaging viewable when a user traverses the base surface in a first direction, and a second profile comprising a second set of surface colors providing a second directional messaging viewable when a user traverses the base surface in a second direction, wherein one or more coatings provide or enhance at least a portion of one or both the first set of surface colors and the second set of surface colors.

2. The directional surface marking device of claim 1, wherein at least a portion of one or both the first directional messaging and the second directional messaging comprises one or more text or symbol.

3. The directional surface marking device of claim 1, further comprising a heating layer configured to limit accumulation of frozen precipitate over the profile layer.

4. The directional surface marking device of claim 1, wherein at least a portion of the profile layer is integrated into the base surface.

5. The directional surface marking device of claim 1, wherein one or more profile layer materials provide at least a portion of one or both the first set of surface colors and the second set of surface colors.

6. The directional surface marking device of claim 1 further comprising one or more illumination sources.

7. The directional surface marking device of claim 5, wherein the one or more illumination sources are located within the topography of the profile layer.

8. The directional surface marking device of claim 5, wherein at least a portion of the one or more illumination sources are passive.

9. The directional surface marking device of claim 5, wherein at least a portion of the one or more illumination sources require a power source.

10. The directional surface marking device of claim 5, wherein at least a portion of the one or more illumination sources comprise a secondary alert mechanism.

11. The directional surface marking device of claim 5, wherein the illumination sources provide at least a portion of the first set of surface colors.

12. The directional surface marking device of claim 11, wherein the illumination sources make one or both the first directional messaging and the second directional messaging more visible.

13. A directional surface marking device comprising:

a first profile layer comprising a first visible profile, wherein the first visible profile comprises a first color set providing a first directional messaging;

a second profile layer comprising a second visible profile, wherein the second visible profile comprises a second color set providing a second directional messaging, wherein the first profile layer and the second profile layer are combinable to form a combined profile layer installable parallel to a base surface, wherein, when installed, a topography of the combined profile layer allows for:

the first directional messaging to be viewable when a user traverses the base surface in a first direction, and the second directional messaging to be viewable when a user traverses the base surface in a second direction, wherein one or more coatings provide or enhance at least a portion of one or both the first color set and the second color set.

14. The directional surface marking device of claim 13, wherein one or both the first profile layer and the second profile layer comprise a congruous segment.

15. The directional surface marking device of claim 13, wherein the first profile layer comprises at least a first material and the second profile layer comprises at least a second material.

16. The directional surface marking device of claim 15, wherein the first material and the second material are different.

17. The directional surface marking device of claim 15, wherein the first material provides at least a portion of the first color set, and the second material provides at least a portion of the second color set.

18. The directional surface marking device of claim 13, further comprising one or more illumination sources.

* * * * *